US006907687B2

(12) United States Patent
Rousseau et al.

(10) Patent No.: US 6,907,687 B2
(45) Date of Patent: Jun. 21, 2005

(54) OVER-AND-UNDER SHOTGUN APPARATUS AND METHOD

(75) Inventors: Joseph F. N. Rousseau, Mountain Green, UT (US); Dwight M. Potter, Liberty, UT (US)

(73) Assignee: Browning Arms Company, Morgan, UT (US)

( * ) Notice: Subject to any disclaimer, the term of this patent is extended or adjusted under 35 U.S.C. 154(b) by 0 days.

(21) Appl. No.: 10/307,722

(22) Filed: Dec. 2, 2002

(65) Prior Publication Data

US 2004/0103575 A1 Jun. 3, 2004

(51) Int. Cl.[7] ..... F41A 21/00
(52) U.S. Cl. ..... 42/75.02; 42/75.04
(58) Field of Search ..... 42/75.02, 75.04, 42/75.1, 75.03

(56) References Cited

U.S. PATENT DOCUMENTS

| | | | | | |
|---|---|---|---|---|---|
| 255,330 | A | * | 3/1882 | Pierce | 42/40 |
| 262,521 | A | * | 8/1882 | Whitmore | 42/40 |
| 804,349 | A | * | 11/1905 | Stenbach | 42/40 |
| 926,456 | A | * | 6/1909 | Behr | 42/40 |
| 1,661,949 | A | * | 3/1928 | Krenek | 42/77 |
| 1,924,656 | A | * | 8/1933 | Ribe | 42/40 |
| 4,328,635 | A | * | 5/1982 | Klavestad | 42/12 |
| 4,519,156 | A | * | 5/1985 | Shaw | 42/77 |
| 4,541,192 | A | * | 9/1985 | Flodman et al. | 42/40 |
| 4,646,459 | A | * | 3/1987 | Brass | 42/47 |
| 4,691,462 | A | * | 9/1987 | Mattarelli | 42/75.04 |
| 4,718,186 | A | * | 1/1988 | Mattarelli | 42/75.04 |
| 4,964,232 | A | * | 10/1990 | Mainland et al. | 42/44 |
| 5,092,068 | A | * | 3/1992 | Rick | 42/64 |
| 5,311,692 | A | * | 5/1994 | Blaser | 42/42.01 |
| 5,467,549 | A | * | 11/1995 | Rowlands et al. | 42/42.03 |
| 5,933,998 | A | * | 8/1999 | Plebani | 42/75.04 |
| 6,470,617 | B1 | * | 10/2002 | Gregory et al. | 42/75.04 |
| 6,564,691 | B2 | * | 5/2003 | Butler | 89/191.01 |

OTHER PUBLICATIONS

Product brochure of Damasteel AB, "The New Generation Damascene Steel Barrels," date unknown.

Product brochure of Flodman Guns Sweden, "Flodman," date unknown.

Product literature of Damasteel AB, "Flodman," date unknown.

* cited by examiner

*Primary Examiner*—Michael J. Caroni
*Assistant Examiner*—Troy Chambers
(74) *Attorney, Agent, or Firm*—Holland & Hart

(57) ABSTRACT

An over-and-under shotgun apparatus includes a radius track which serves as a hinge for articulating the barrel portion of the shotgun apparatus relative to the receiver/stock portion of the shotgun apparatus. The radius track is defined by a female or concave portion formed on the monoblock attached to the shotgun barrels, and a male or convex portion formed on the frame or receiver section. The radius track defines a pivot axis that is spaced from the radius track. The radius track provides a substantial surface area sufficient to absorb all of the recoil force generated when the shotgun is discharged. No additional abutment surfaces are needed. A further aspect of the invention involves a novel trigger assembly, including a striker which moves toward the front end of the firearm when the firearm is cocked, and moves toward the butt end of the firearm when the trigger is pulled to discharge the firearm. Yet another novel aspect of the invention relates to a four-position safety switch for selecting the firing sequence of the upper and lower barrels.

13 Claims, 22 Drawing Sheets

OVER-AND-UNDER SHOTGUN APPARATUS AND METHOD

TECHNICAL FIELD

This invention relates to firearms, and more particularly to over-and-under double barrel shotguns.

BACKGROUND OF THE INVENTION

Firearms of the shotgun variety have existed in many different forms and types for many decades. Different types of shotguns have been developed for different types of shooting. For example, and without limitation, there are single-shot, break-action shotguns, side-by-side double barrel shotguns, over-and-under double barrel shotguns, pump-action single barrel shotguns, semi-automatic shotguns, and various other types of shotguns. Shotgun technology continues to evolve to meet the diverse needs of shooting sports enthusiasts. Many factors are considered in designing shotguns, such as appearance, weight, feel, ease of use, end use, and individual preferences of shooters.

Over-and-under double barrel shotguns, in particular, are extremely popular among shooting enthusiasts. Over-and-under shotguns are particularly suitable for sporting clays. The present invention relates to improvements in over-and-under shotguns.

The overall weight of an over-and-under shotgun is a primary concern for all models and types of such shotguns. The lighter the shotgun, the easier it is to handle. Where competitive shooting places a premium on rapid handling and aiming, such as in sporting clays, weight is particularly important.

Another major design concern relates to the feel of the over-and-under shotgun. Typically the sleeker the shotgun design, the easier it is to handle and control. Factors such as the overall height, width, and contour of the shotgun contribute to its sleekness and its "feel" characteristics.

Still another important factor with respect to over-and-under shotguns relates to the overall appearance of the firearm. Generally, a thinner, sleeker shotgun has a better appearance. Such sleek designs make the shotgun appear easy to control and handle. Larger designs appear more bulky and cumbersome, and thus more difficult to handle and control.

Traditional over-and-under shotguns have typically involved a full-pin or trunnion-type hinge. That is, the hinge mechanism, which allows the barrel/receiver section to be pivoted away from the stock portion of the firearm, articulates about a specific pivot point typically defined by a full-pin hinge or a trunnion. A full-pin design requires a substantial amount of material surrounding the pin or trunnion and thus a greater dimension in terms of the overall height of the shotgun. This works against the design goal of making a sleeker, low-profile shotgun.

Another particular challenge with respect to over-and-under shotguns relates to the surfaces that bear the load of the recoil force upon discharging the shotgun. Typically, traditional over-and-under shotguns have required at least two separate load-bearing surfaces to absorb the recoil shock of the shotgun. The tolerances of such multiple load-bearing surfaces must be extremely precise to even begin to approach an equalized load distribution of the recoil force on these multiple load-bearing surfaces. Where the tolerances are not precise, a common problem with respect to over-and-under shotguns, one of the load-bearing surfaces absorbs most or substantially all of the recoil force. After time, this causes the working or moving parts of the firearm to loosen up or become sloppy in their action.

A major reason for the need to have two load-bearing surfaces relates to surface area. Where only a limited amount of surface area exists with respect to a particular hinge (i.e., a full-pin or trunnion-type hinge), additional surface area is generally required to absorb the shock generated by the recoil of the firearm upon discharge. Accordingly, because the surface area surrounding the hinge portion itself cannot be increased, a second load-bearing surface area must be provided to absorb a portion of the shock of the recoil force. Tolerances of the load-bearing surfaces must be tight where dual load-bearing surfaces are required.

Still another problem with respect to traditional over-and-under shotguns relates to the need to notch the bottom surface of the receiver portion of an over-and-under shotgun to accommodate full articulation of the barrel section relative to the receiver section. This type of full articulation is required to allow the firearm to eject the spent casings and allow new shotgun shells to be loaded into the chambers. A need exists, therefore, with respect to an appropriate over-and-under shotgun design that would remove the need to notch the forearm portion of the firearm.

SUMMARY AND OBJECTS OF THE INVENTION

In view of the foregoing, it is a primary object of the present invention to provide an over-and-under shotgun apparatus that is lightweight, easy to handle, and sleek looking.

Another object of the invention is to provide an over-and-under shotgun apparatus that has a low profile.

Another object of the present invention is to provide an over-and-under shotgun apparatus that has a novel hinge for articulating one portion of the shotgun apparatus relative to another portion.

Still another object of the present invention is to provide an over-and-under shotgun apparatus that includes a substantial abutment surface for absorbing the shock associated with the recoil force resulting from discharge of the shotgun.

Another object of the present invention is to provide an over-and-under shotgun apparatus that is easy to handle and control.

Another object of the present invention is to provide an over-and-under shotgun apparatus that includes a substantial abutment surface defined at least in part by a curved edge of the receiver portion and a corresponding curved edge of the monoblock of the barrel section.

Yet another object of the invention is to provide an over-and-under shotgun apparatus that has a sleeker, slimmer appearance.

Still another object of the invention is to provide an over-and-under shotgun apparatus that includes an abutment surface between the receiver portion and the barrel portion of the shotgun, the abutment surface defining a pivot axis spaced from the abutment surface about which the barrel portion articulates relative to the shotgun receiver portion.

Another object of the invention is to provide an over-and-under shotgun apparatus that includes an abutment surface which also serves as a hinge surface, the abutment surface providing a substantial surface area for absorbing the recoil shock of the shotgun upon discharging the shotgun.

Another object of the invention is to provide an over-and-under shotgun apparatus according to the present invention that provides a sufficient abutment surface for absorbing the load of the recoil upon discharging the shotgun. The abutment surface also provides a radius track hinging surface to eliminate the need for any pin or trunnion hinge.

Yet another object of the present invention is to provide an over-and-under shotgun apparatus that provides a unique hinge mechanism for articulating the barrel portion relative to the receiver portion such that no notching is required on the bottom surface of the receiver portion of the firearm.

Another object of the present invention is to provide an over-and-under shotgun apparatus that utilizes a linkage assembly which takes a rearwardly-directed compressive spring force of a trigger assembly, reverses such force, and redirects the force toward the forward portion of the firearm to actuate the firing pin.

Another object of the invention is to provide an over-and-under shotgun apparatus that involves a firing pin that is cocked by moving a coil spring toward the forward portion of the shotgun.

Another object of the invention is to provide an additional safety such that if the trigger is not pulled, and the striker attempts to move toward the rear end of the firearm, the striker is blocked by the trigger and will not discharge.

Another object of the present invention is to provide an over-and-under shotgun apparatus that will maintain a tight construction over an extended period of the life of the shotgun.

The foregoing objectives are achieved by an over-and-under shotgun apparatus according to the invention. The novel shotgun apparatus comprises a radius track abutment surface comprising a first engagement surface located on the receiver section of the firearm and a second engagement surface located on the monoblock of the barrel section of the firearm. The engagement surfaces are curved in the form of a radius track such that they slidingly engage each other upon articulation of the barrel section relative to the receiver section of the shotgun apparatus. The engagement surfaces provide a substantial surface area sufficient to absorb the shock of the recoil force upon discharging the firearm. No additional abutment or engagement surface other than the radius track abutment surface, is necessary to assist in absorbing the recoil force upon discharge of the shotgun. Still further, the engagement surfaces are uniquely defined by a female or concave portion formed on the monoblock of the barrel portion of the shotgun apparatus and a male or convex portion formed on the receiver portion of the shotgun apparatus. The construction of this type of a hinge allows the overall profile of the shotgun apparatus to be small because the pivot axis defined by the engagement surfaces is remote from the engagement surfaces. No specific hinge or trunnion is required at the specific pivot axis, as with most traditional shotguns and thus the height dimension of the shotgun can be reduced.

The unique radius track abutment surface also causes the barrel to pull away from the receiver when the breech is opened, thus eliminating the need to provide a clearance cut in the receiver portion, which is generally required in most types of over-and-under shotgun designs.

Another aspect of the present invention involves a unique reverse-direction trigger assembly. The main trigger coil spring is cocked by compressing the spring toward the muzzle end of the firearm. Upon pulling the trigger, the trigger spring is released and exerts a rearward force on a linkage assembly which, in turn, redirects the force toward a firing pin in a direction toward the forward portion or muzzle end of the shotgun. Because of this unique trigger assembly, a unique safety mechanism (described below) can be provided.

Other objects, features, and advantages of the invention will become apparent from the following detailed description of the invention with reference to the accompanying drawings.

BRIEF DESCRIPTION OF THE DRAWINGS

Preferred embodiments of the invention are described below with reference to the accompanying drawings.

DETAILED DESCRIPTION OF THE INVENTION

Figure 1:
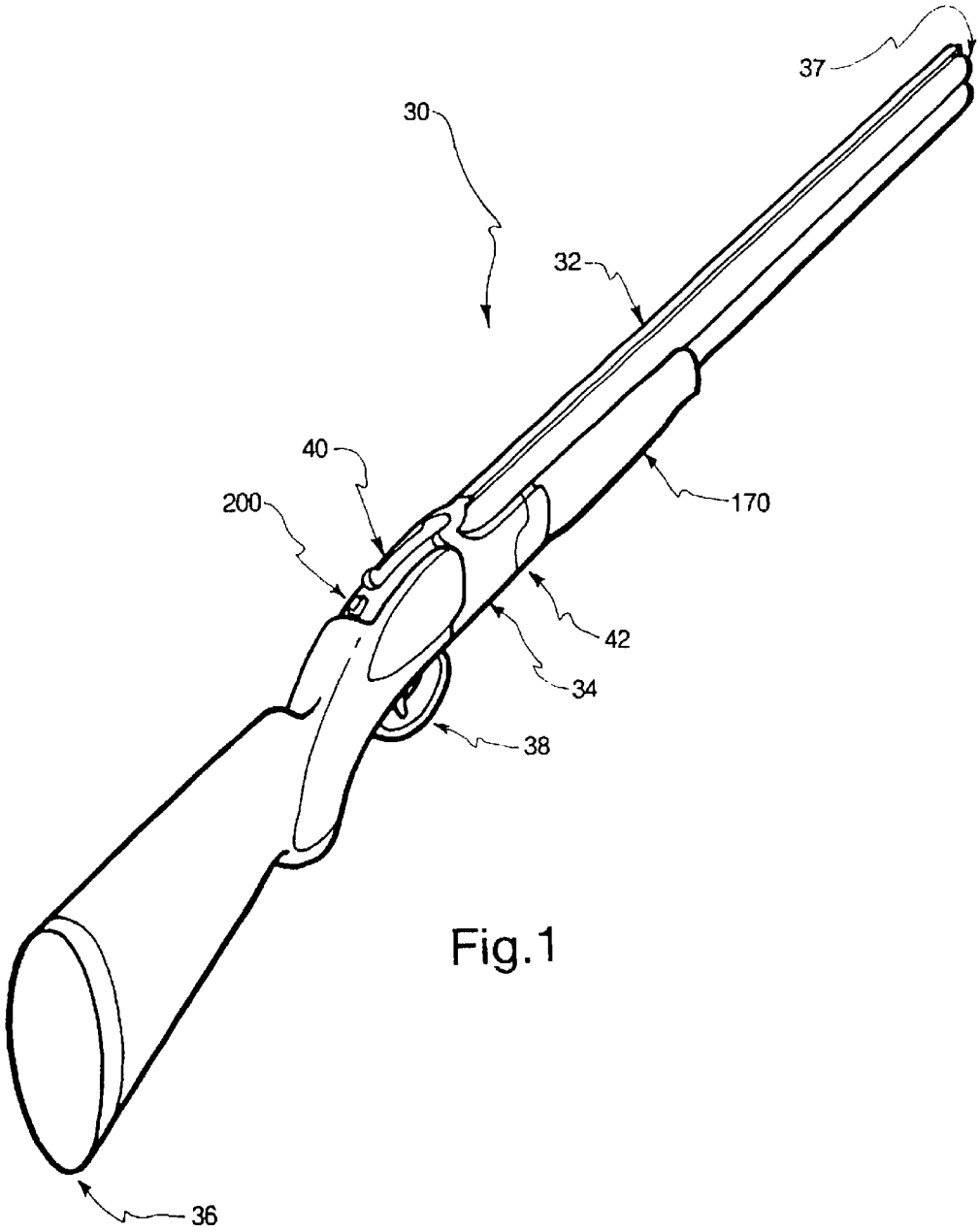
FIG. 1 is a perspective view of an over-and-under shotgun according to the present invention.

As shown in FIG. 1, the present invention relates to a shotgun apparatus 30 comprising generally a barrel section 32 located at the fore or distal end of the firearm and a receiver/stock section 34 located at the aft or proximal end of the shotgun apparatus. The barrel section 32 includes a monoblock 60 to which an upper barrel 62 and a lower barrel 64 are attached. A pair of ejector systems 56, 58 are also housed by the barrel section 32.

The receiver section 34 houses the trigger assembly 38, the locking system 100, the internal cocking links, the safety assembly 120, and various other working parts of the shotgun apparatus 30. The stock of the shotgun is attached to the rear portion of the receiver.

The shotgun apparatus 30 according to the present invention comprises, in one embodiment, an over-and-under shotgun. A barrel assembly 32 comprises a first or upper barrel 62 (FIG. 3) aligned with and mounted directly above a second or lower barrel 64. The over-and-under shotgun 30 further comprises a butt end 36, which may include a recoil pad, and a muzzle end 37. The firearm 30 further comprises a trigger assembly 38 for discharging the firearm, and a lever-actuated locking system 40 to open the breech of the shotgun apparatus. The barrel portion 32 terminates at the muzzle end of the shotgun.

Figure 6:
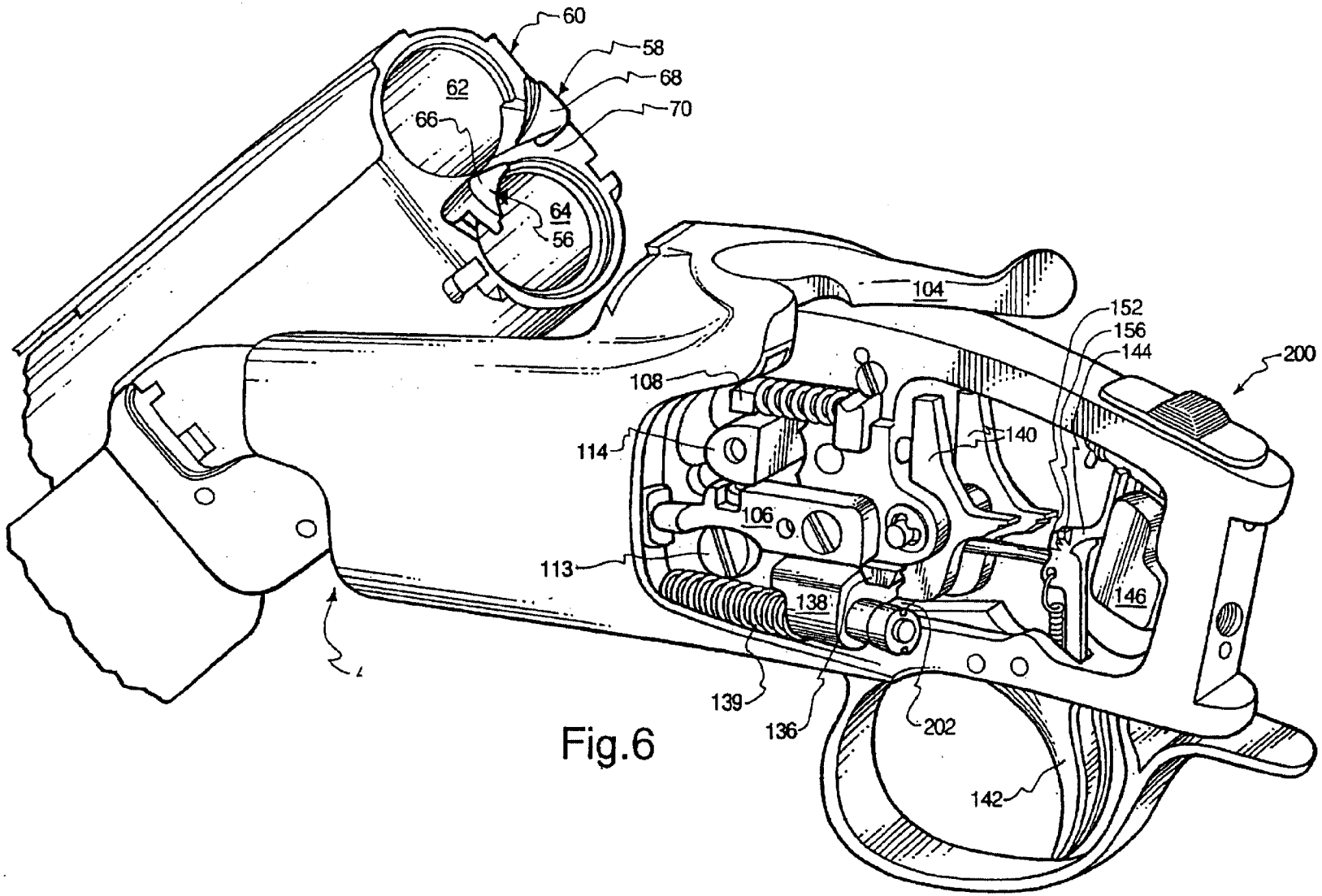
FIG. 6 is a perspective view of a portion of the over-and-under shotgun of FIG. 1, with the breech of the shotgun in a fully opened position.
Figure 7:
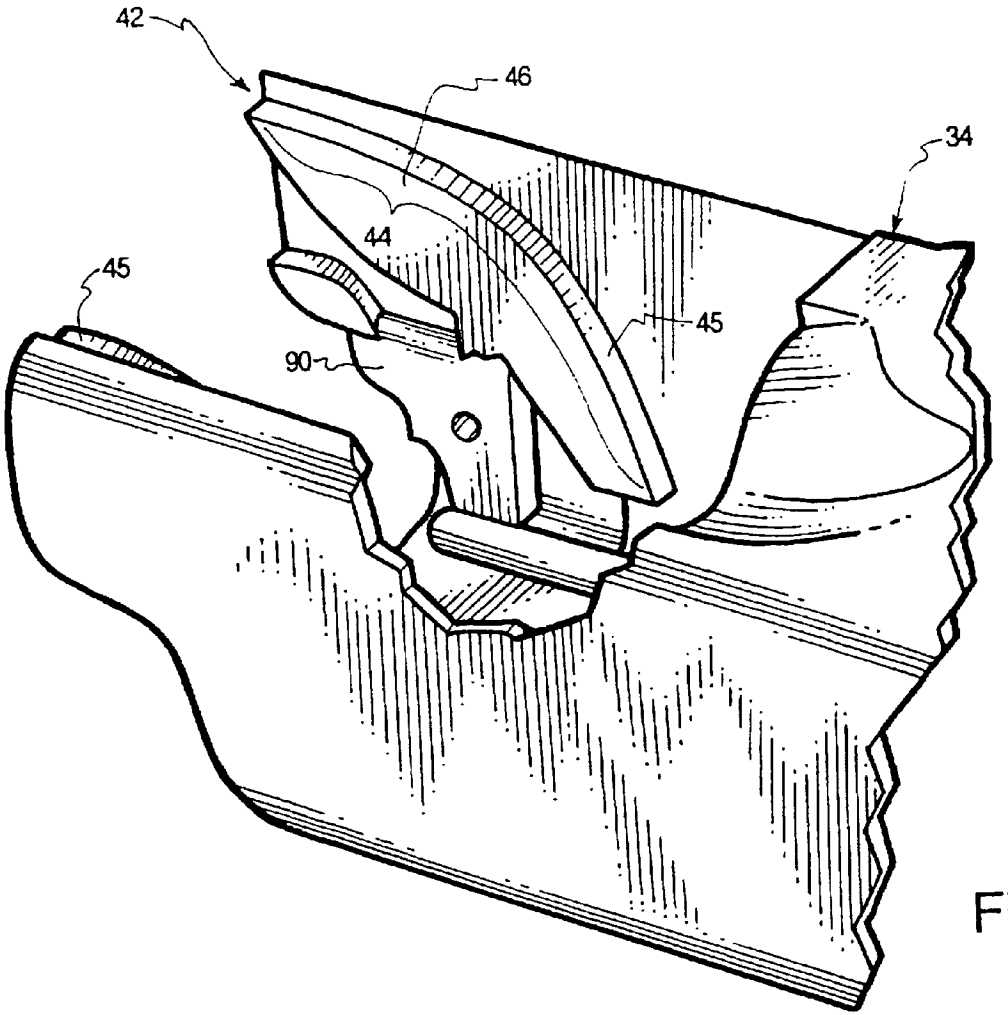
FIG. 7 is a partial perspective view of a portion of the receiver showing interior details of one side of the radius track.
Figure 8:
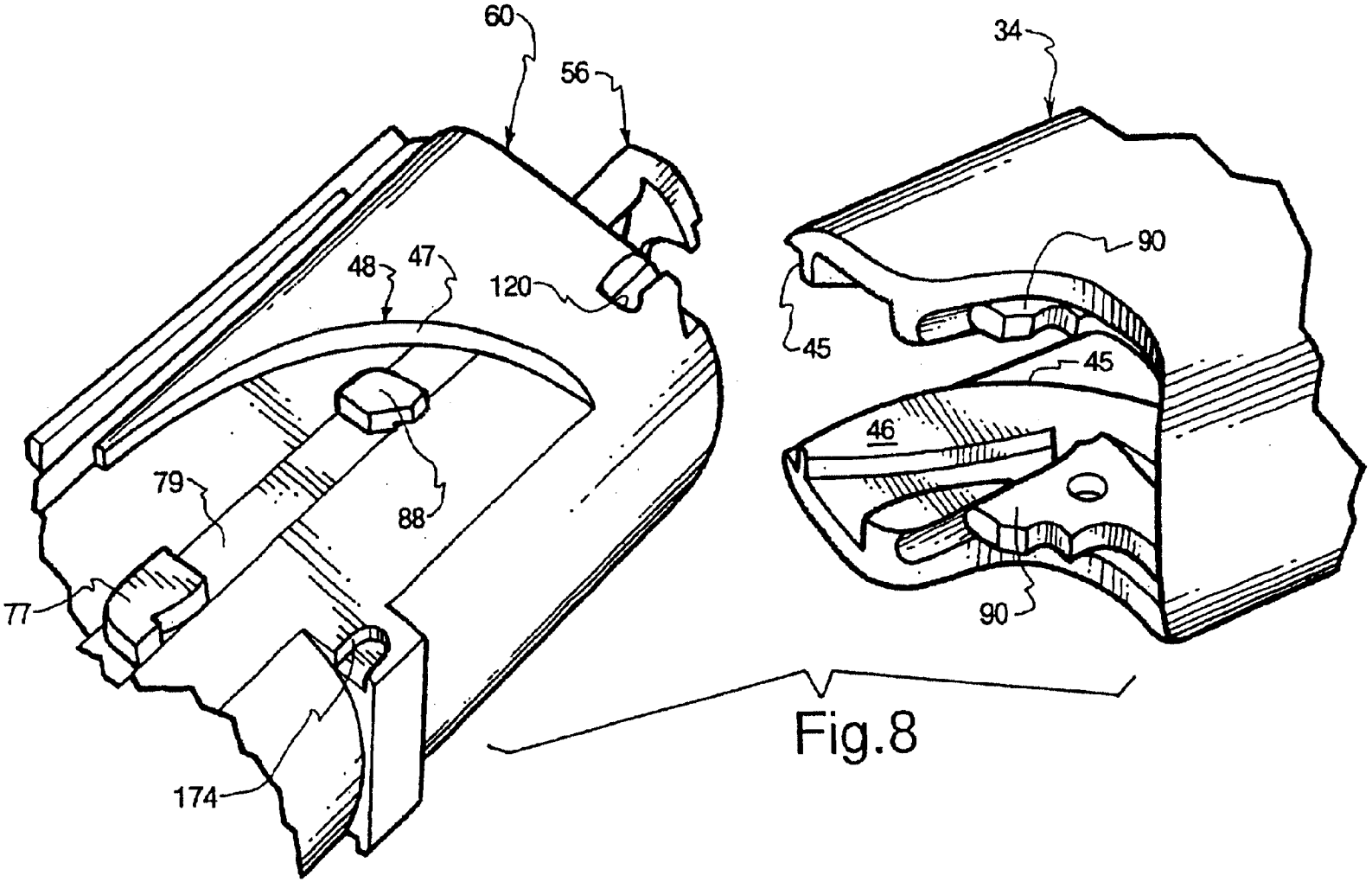
FIG. 8 is a partial perspective view of a portion of the monoblock and the portion of a receiver of the over-and-under shotgun of FIG. 1, with the monoblock and receiver separated from one another.

FIGS. 7-8 show a hinge assembly 42 which is defined, in part, by a male hinge portion 46 (FIG. 7) formed on the frame or receiver section 34 and a female hinge portion 48 (FIG. 8) formed on the monoblock 60 of the barrel section 32 of the shotgun apparatus. On the male hinge portion 46, a curved abutment area 44 (i.e., a radius track) is defined. Abutment area 44 further comprises a convex abutment surface 45 which provides a primary bearing surface for slidingly engaging a corresponding concave abutment surface 47 (FIG. 8) formed within the female hinge portion 48 on the monoblock 60. Although only one is shown in FIGS. 1–6, the invention comprises a pair of abutment areas 44 and abutment surfaces 45, 47 formed on each side of the firearm 30. Abutment areas 44 and abutment surfaces 45, 47 serve as both hinge and bearing surfaces for articulating the barrel section 32 relative to the receiver/stock section 34 and for absorbing the recoil force of the firearm upon discharge. The hinge assembly 42 defines a pivot axis 50 (FIG. 3), which is remote or spaced from abutment areas 44. No actual hinge exists at pivot axis 50. The first curved abutment surface 45 and the second curved abutment surface 47 (FIG. 8) bear against each other to form the hinge. The first and second abutment surfaces 45, 47 slidingly engage each other along the radius track in a variably overlapping relationship (depending on the degree to which the barrel portion 32 is articulated relative to receiver/stock portion 34).

A primary benefit of the present invention relates to the amount of surface area provided by abutment surfaces 45 and 47 of the radius track 44. When the shotgun apparatus breech is closed, the surface areas of abutment surfaces 45 and 47 engage each other along substantially the entire radius track 44 (FIG. 7). This provides a substantial surface area which is sufficient, without more, to adequately absorb the recoil force upon discharge of the shotgun. In contrast to the present invention, most other traditional over-and-under shotguns require two separate abutment surfaces to provide a sufficient abutment surface area to absorb the shock associated with the recoil force of the shotgun upon discharge. In one embodiment, the abutment surface 45 of radius track 44 is approximately ⅛' wide and approximately 2⁵⁄₁₆' long. It is to be understood, however, that these dimensions may vary without departing from the scope and spirit of the present invention. As shown in FIGS. 7–8, convex portion 46 and concave portion 48 engage each other along their respective lengths and widths and the substantial portion of their lengths along abutment surfaces 45 and 47. Therefore, the total surface area of the radius track 44 is substantial relative to the surface area of a traditional fixed-hinge or trunnion provided on over-and-under shotgun devices. Given the substantial abutment surface provided by the radius track 44 of the present invention, abutment area or radius track 44 is capable of absorbing all of the recoil force generated upon discharge of the firearm. No additional or second abutment area is needed, as with traditional over-and-under shotguns. Furthermore, because two separate abutment surfaces are unnecessary, there is no need to coordinate the tolerances relative to different and spacially separate engagement surfaces. Traditionally, the tolerances of two or more abutment surfaces must be precisely controlled so that one abutment surface does not bear more load than the other abutment surface. Otherwise, after several rounds have been discharged, the moving parts and action of the shotgun will loosen up. The present invention requires no such critical tolerance coordination because of the single, substantial abutment surface provided by each radius track 44.

Another significant advantage of the radius track or abutment area 44 is that the radius track itself provides the hinging or bearing surfaces against which the two portions of the shotgun engage for articulation. Unlike prior art, over-and-under shotguns, where a specific pivot pin, bushing, or trunnion is provided at the precise pivot point, the pivot axis 50 (FIG. 3) defined by the radius track or abutment area 44 is spaced from the actual hinge surfaces (i.e., the abutment surfaces 45, 47). Accordingly, the actual location of the pivot axis 50 does not need to be located at a position on the shotgun apparatus corresponding to a substantial amount of structure. In fact, the defined pivot axis 50 may correspond with a location where no structure exists (i.e., below the lowermost structure of the firearm), depending on the actual radius of the abutment area 44, without departing from the scope of the present invention. No actual trunnion or other hinge device is needed at pivot axis 50. This allows the shotgun to have a lower profile. If a specific trunnion or bushing was required to be placed at pivot axis 50, substantial structure would be needed on the shotgun surrounding the pivot axis. This would necessitate, in turn, a greater overall height dimension of the shotgun. Accordingly, the novel radius track of the present invention results in a sleeker, lighter, and easier-to-handle shotgun apparatus. For example, the shotgun 30 (FIG. 1) may have a vertical top-to-bottom dimension D1 of less than 2½ inches according to some embodiments, which may be approximately 2⅜ inches according to FIG. 1.

Figure 3:
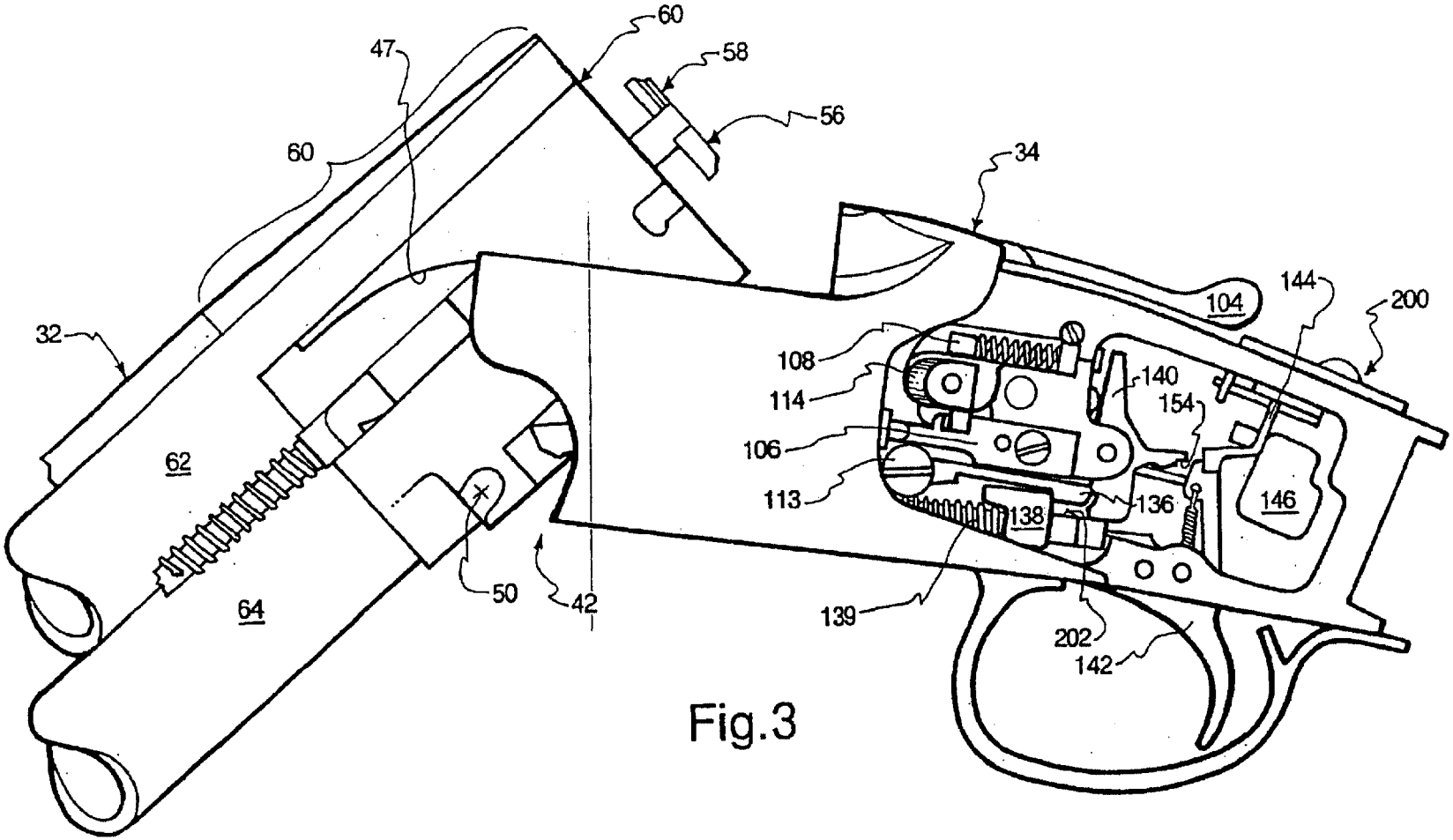
FIG. 3 is a partial side elevation view showing a portion of the over-and-under shotgun of FIG. 1, with the breech of the shotgun in an opened position.

FIGS. 3 and 6 show ejector assemblies 56, 58 operably mounted to the monoblock 60 of the barrel section 32 of the present invention. As shown in FIG. 3, the monoblock 60 provides the first part of barrels 62, 64, and interfaces with the receiver/stock section 34. The monoblock 60 further serves to rigidly connect the top barrel 62 and the bottom barrel 64 of the over-and-under shotgun apparatus 30. Upon articulation of the barrel section 32 relative to the receiver/stock section 34, the ejector assemblies 56, 58 cause the ejector heads 66, 68 (which engage the underside of the flanged portion of the shotgun shells) to move outwardly from the base end 70 (FIG. 6) of the monoblock 60. The ejector heads 66, 68 are intended to be thrust outwardly with sufficient force to discharge in its entirety a spent shotgun shell from the monoblock. If the shotgun shell is not, for whatever reason, discharged, the ejector heads 66, 68 will push the shotgun shells away from the base end 70 of the monoblock sufficiently (approximately 10 millimeters) to allow the shooter to easily remove the shell(s) from the chamber.

Figure 9:
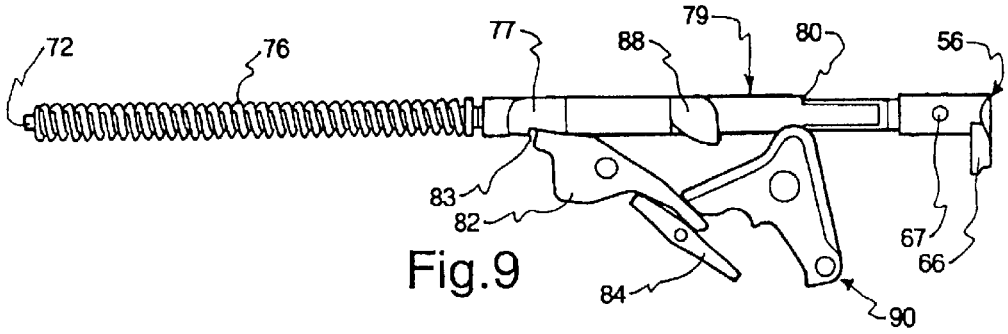
FIG. 9 is a side elevation view of an ejector system according to the present invention showing the ejector parts after the firearm has been discharged.
Figure 10:
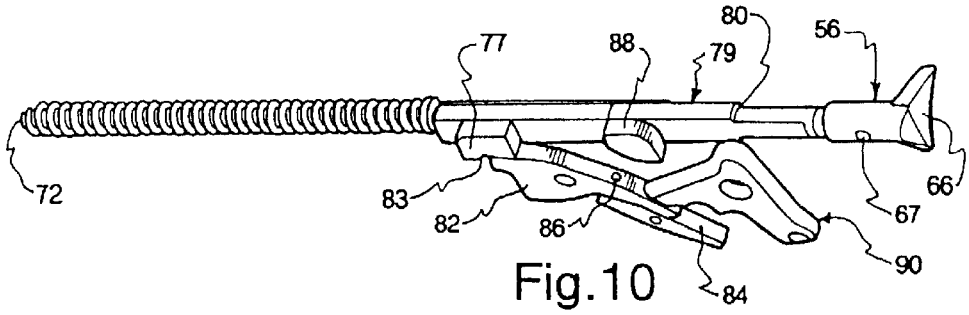
FIG. 10 is a perspective view of the ejector system of FIG. 9.
Figure 11:
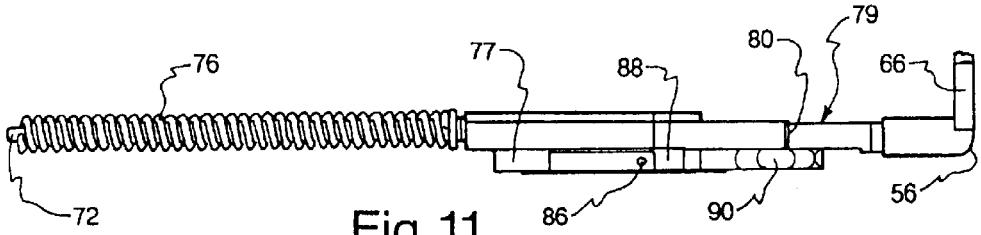
FIG. 11 is a top view of the ejector system of FIG. 9.
Figure 12:
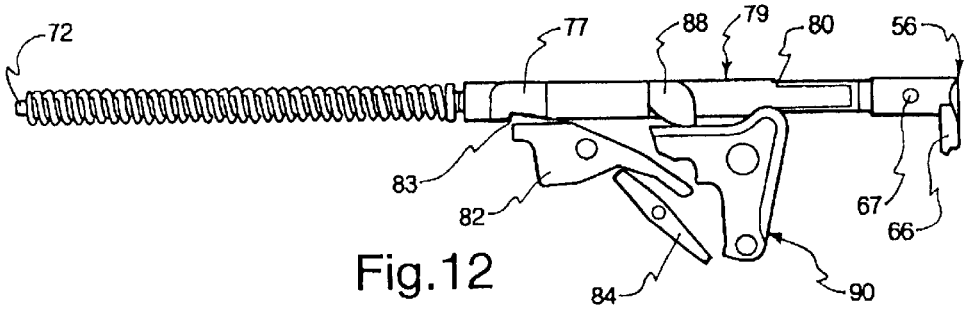
FIG. 12 is a side elevation view of an ejector system of the over-and-under shotgun of FIG. 1, showing the ejector parts before the firearm has been discharged.
Figure 13:
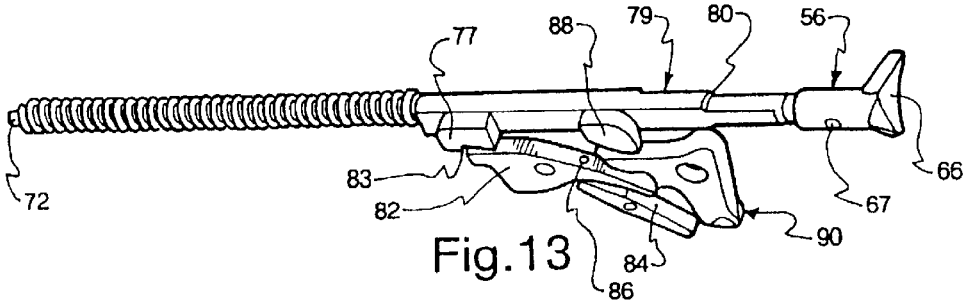
FIG. 13 is a perspective view of the ejector system of FIG. 12.
Figure 14:
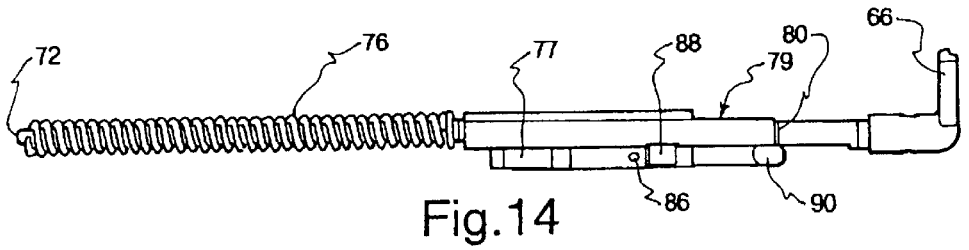
FIG. 14 is a top view of the ejector system of FIG. 12.

FIGS. 9–14 show the details of the ejector assembly without the frame or the barrels. FIGS. 9–11 show the ejector components of ejector system 56 after the gun has been fired. FIGS. 12–14 show the ejector parts of ejector system 56 before the gun is fired. Only one ejector system 56 is shown. Ejector system 58 is identical in terms of operation and structure to ejector system 56. Therefore, only ejector system 56 is discussed.

The ejector system 56 comprises an ejector spring 76 which provides an outward bias on the other ejection parts. An ejector spring guide 72 holds the spring in place. The combined spring 76 and spring guide 72 are inserted into appropriately sized apertures formed in the barrels and are held by place by appropriate stops formed inside the barrel assembly. An ejector striker 77 is coupled to the ejector assembly. A cam link 79 forms part of the ejector assembly and is guided by the firearm frame. The ejector striker 77 acts as a hammer and hits into the head of the cam link 79 during ejection of the cartridges. The cam link 79 further includes a shoulder 80 which bears against the monoblock 60 to limit movement of the ejector assembly 56.

The ejector head 66 attaches to the cam link 79 and is used to force the case out of the chamber. An ejector head pin 67 maintains the ejector head 66 coupled to the cam link 79.

An ejector sear 82 is used to retain the spring and striker after the shot. An ejector sear link 82 is used to disengage the injector sear after the gun is opened. Finally, a timing adjustment screw 86 is used to adjust the timing of the ejection between the two barrels.

With the firearm in an open position, cartridges are loaded into the breech end of the barrels. As the gun is closed, a cam section 88 of the cam link 79 is guided by tracks in the frame and forces the ejector parts (i.e., ejector head 66, cam link 79, and ejector striker 77) back into the barrels. The ejector spring 76 provides a constant bias on the ejector parts toward the breech end of the firearm. If the cartridge is unfired, and the firearm is reopened, the ejector spring 76 pushes the cartridge out of the barrels to a travel limit of about ten millimeters.

After the firearm is discharged, a cocking lever 90 rotates forward (FIG. 9) and engages the ejector sear 82, which causes the sear 82 to rotate clockwise so it can engage the notch 83 of the ejector striker 77. When the firearm is opened or placed in the breech position after firing, the ejector sear 82 engages notch 83 of the ejector striker 77 to hold the ejector striker 77 in position. As the breech of the firearm is opened, the cam portion 88 of the cam link 79 is guided by the tracks in the frame. When the ejector striker 77 is caught by ejector sear 82, the spring 76 is prevented from biasing the ejector further outward. Tracks in the frame, however, force it to move approximately three millimeters outward. This is done to break the spent case free from the chamber. When the end of both barrels clear the frame allowing a free path for the spent case to be ejected, the end of the ejector sear link 84 contacts the step-in cocking lever 90. This forces the ejector sear 82 to disengage from the ejector striker 77. The stored energy of the spring 76 is released hitting the end of cam link 79 driving it quickly outward. This expels the spent case out of the chamber. In one embodiment, ejection of each barrel occurs simultaneously. To accomplish this, a timing adjustment screw 86 (FIG. 10) is placed in the ejector sear 82. The adjustment screw 86 bears against the ejector sear link 84 and affects the timing of when it disengages.

The locking system 100 is shown in FIGS. 15–22. The locking system 100 shown in the unlocked position is shown in FIGS. 15–18, and is shown in the locked position in FIGS. 19–22.

Figure 15:
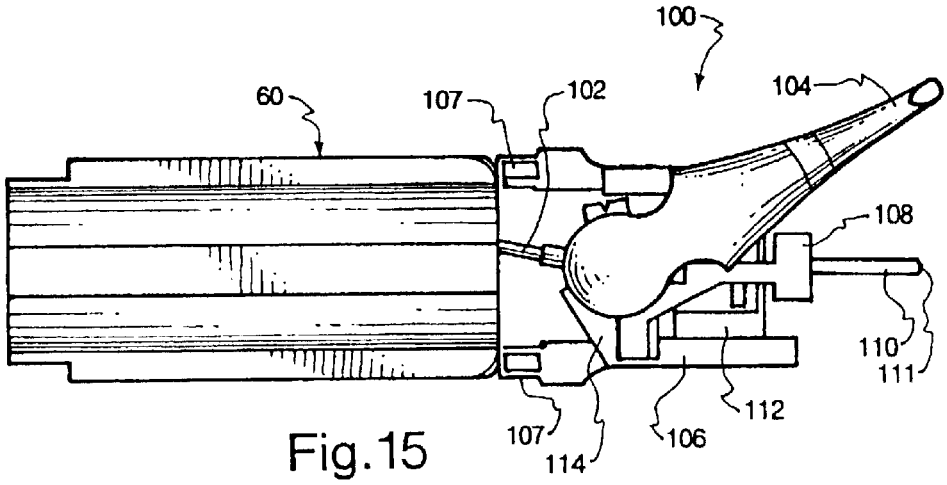
FIG. 15 is a top view of the locking system of an over-and-under shotgun of FIG. 1, showing the locking system parts when the firearm is in an unlocked position.
Figure 16:
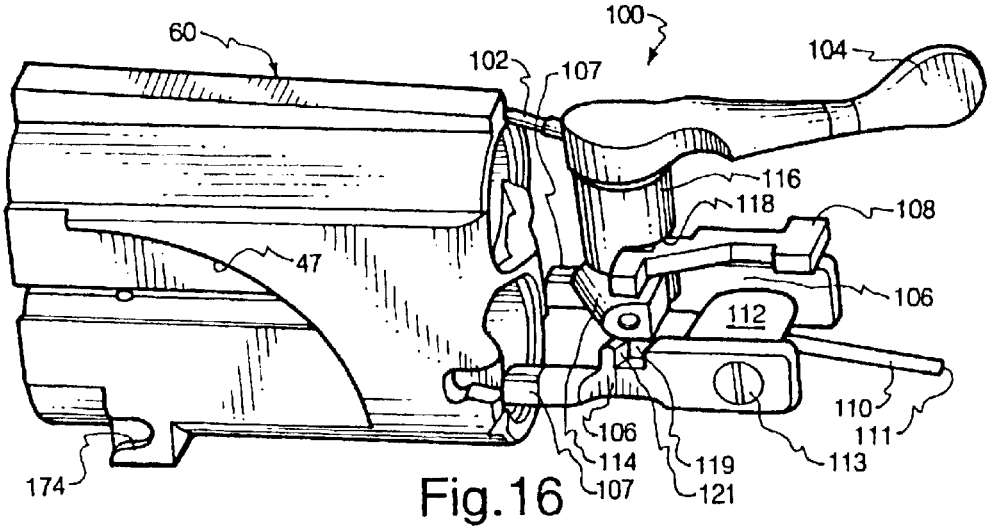
FIG. 16 is a perspective view of the locking system of FIG. 15.
Figure 17:
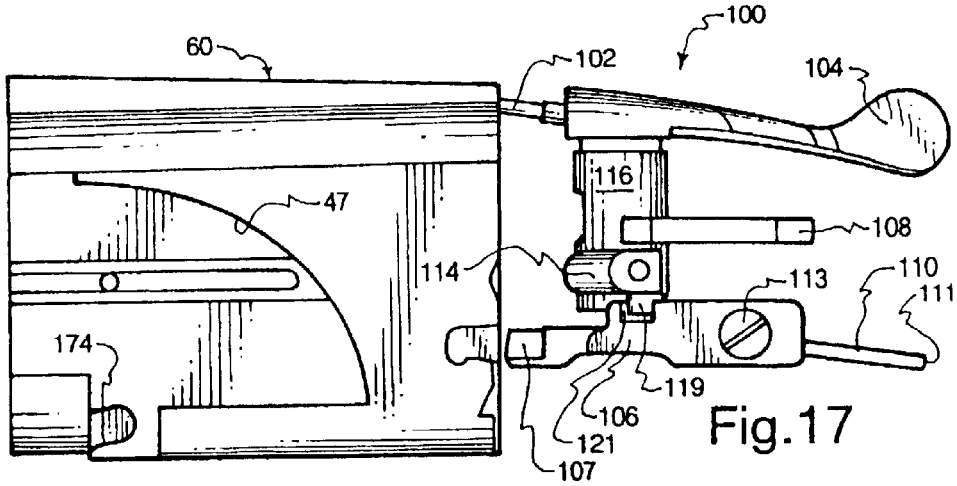
FIG. 17 is a side elevation view of the locking system of FIG. 15.
Figure 18:
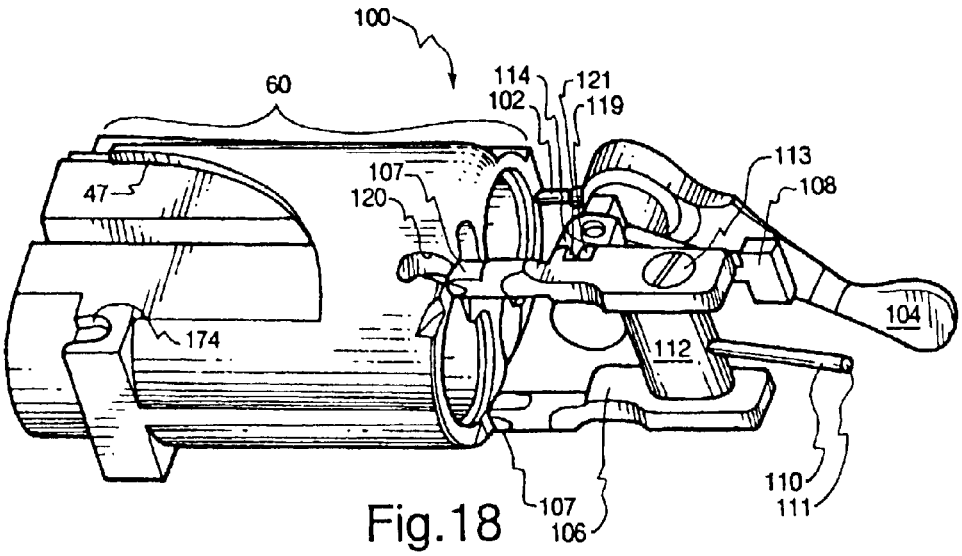
FIG. 18 is a bottom perspective view of the locking system of FIG. 15.
Figure 19:
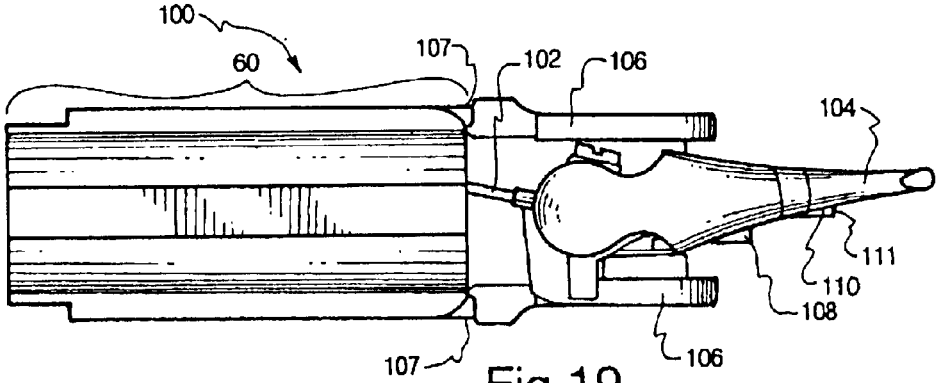
FIG. 19 is a top view of a locking system of the over-and-under shotgun of FIG. 1, showing the locking system in a locked position.
Figure 20:
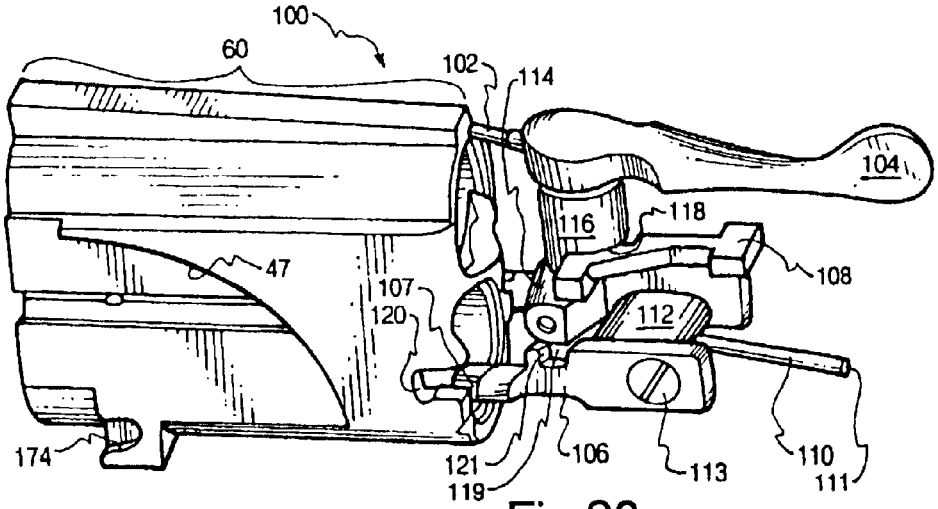
FIG. 20 is a top perspective view of the locking system of FIG. 19.
Figure 21:
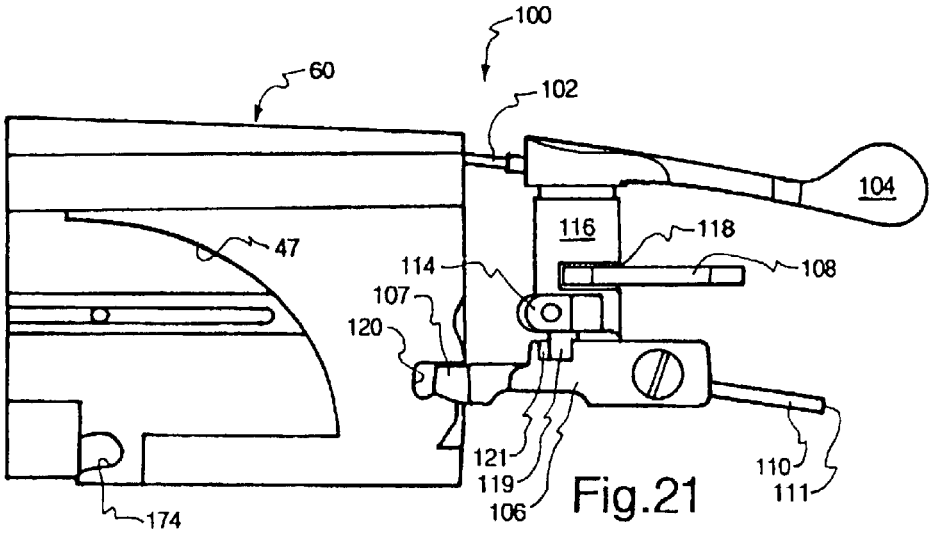
FIG. 21 is a side elevation view of the locking system of FIG. 19.
Figure 22:
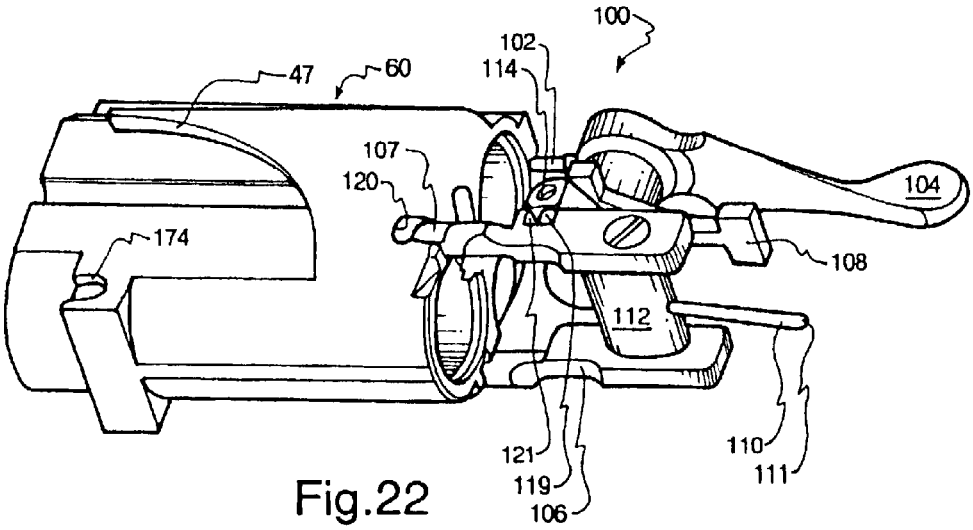
FIG. 22 is a bottom perspective view of the locking system shown in FIG. 19.

The top lever disconnector 102 is used to release the top lever 104 when the gun is closed. A spring-loaded plunger (not shown) is held inside the top lever 104. To unlock the gun, top lever 104 is rotated counterclockwise (as shown in FIG. 15) approximately 30°. In this position, the plunger in the top lever lines up with the aperture in the frame containing the top lever disconnector 102. As the action is opened, the top lever disconnector 102 is pushed forward by the plunger in the top lever 104. With the plunger protruding into the frame, rotation of the top lever is blocked. When the action is closed, the end of the barrels push the distal end of the top lever disconnector 102 back into the frame, which pushes the plunger back into the top lever, freeing its movement. This prevents firing of the system when the gun is not locked. The disconnecting of the trigger link and rockers occurs only when the top lever is rotated as shown in FIG. 15.

The top lever 104 is also used as a crank or lever to move the locking bolts 106 into and out of the slots or grooves 120 in monoblock 60. The rocker disconnector 108 interfaces with top lever 104. As the top lever 104 is rotated, the rocker disconnector 108 is pushed or cammed back by top lever 104 into the rocker 140 (FIGS. 23–31). As the rocker 140 rotates toward the rear of the firearm, the firing pins 135 are allowed to move back out of engagement with the spent primer(s) after the shot(s). This will also block the firing pins if the sear fails while the gun is in an unlocked position. A spring (not shown) pushes the rocker disconnector 108 back to the locked position.

A trigger link disconnector 110 is threadedly coupled to a cross member 112 (FIG. 22) which extends between locking bolts 106. The trigger link disconnector 110 includes a rearward end surface 111 which engages the trigger link to urge the trigger link backward.

A locking cam 114 is attached to the top lever 104 by a fastener (not shown), such as a screw or pin, which will be understood by those skilled in the art. A cylinder body 116 extending downwardly from lever 104 and is coupled to locking cam 114. A groove 118 is formed in the cylinder 116 which receives an end of rocker disconnector 108. As lever 104 is rotated, locking cam 114 rotates which causes the extension piece 116 to move the locking bolts 106 (which are coupled together by cross piece 112) (FIG. 18) back and forth relative to the monoblock.

Locking bolts 106 engage slots 120 formed in the monoblock 60. The locking bolts 106 prevent the action from opening after the breech of the firearm has been closed. The locking bolts 106 include an angled or tapered outside surfaces 107 which facilitate engagement of the locking bolts 106 with the appropriately sized slots 120 in the monoblock. As the contact point at edge 107 wears, the locking bolts 106 are spring loaded to maintain a tight fit.

As mentioned, cross member 112 holds the locking bolts 106 together and forces them to move as a single unit. The locking bolts 106 and cross member 112 may be machined or otherwise formed as a single unit. Alternatively, the combined locking bolts 106 and cross member 112 may be manufactured by assembling separate parts. A pair of screws 113 (only one shown) holds the locking bolts 106 and the cross member 112 together.

The monoblock 60 is designed to interface with the frame (i.e., the receiver 34—FIG. 3) and the locking system 100, on the one side, and with barrel tubes 62, 64 (FIG. 3) on the other.

Figure 23:
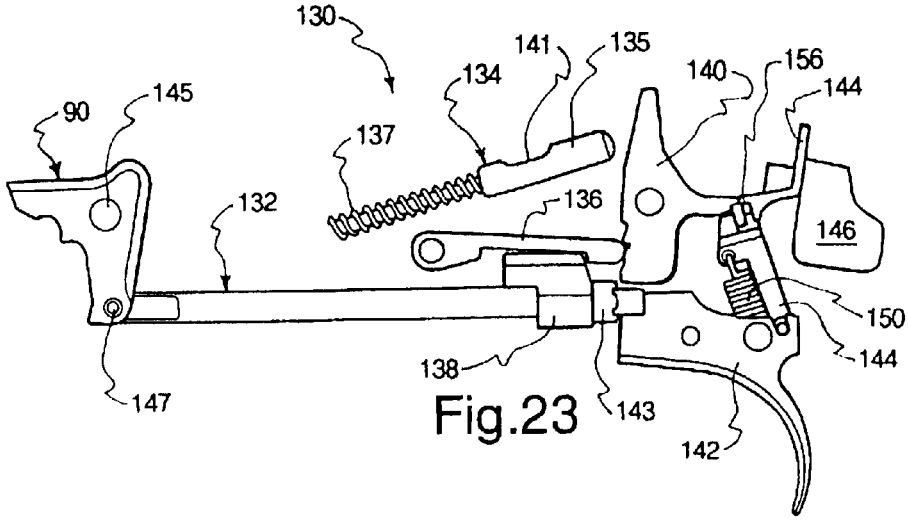
FIG. 23 is a side elevation view of a trigger assembly of the over-and-under shotgun of FIG. 1, showing the trigger assembly before the trigger is pulled.
Figure 24:
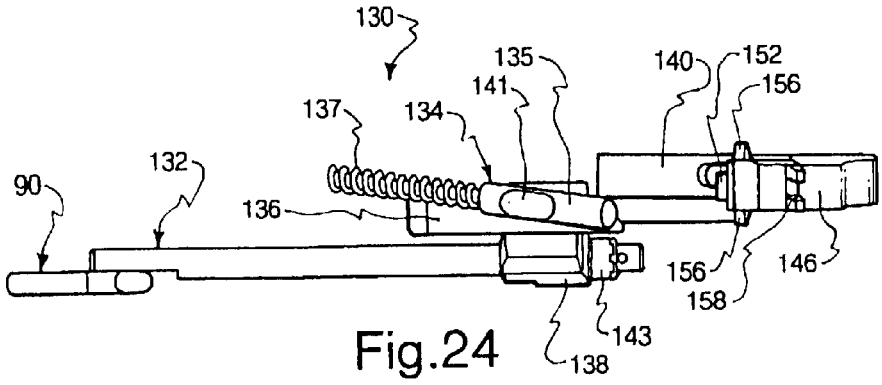
FIG. 24 is a top view of the trigger assembly of FIG. 23.
Figure 25:
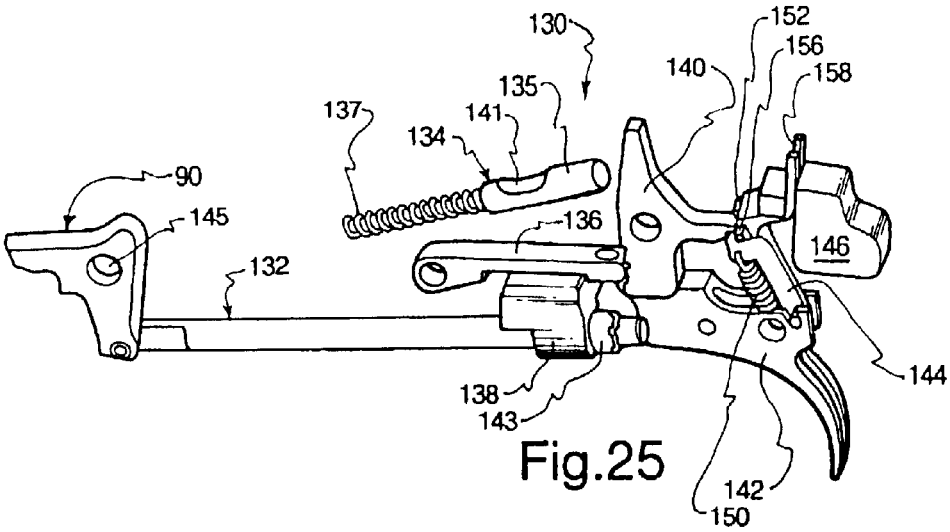
FIG. 25 is a perspective view of the trigger assembly of FIG. 23.
Figure 26:
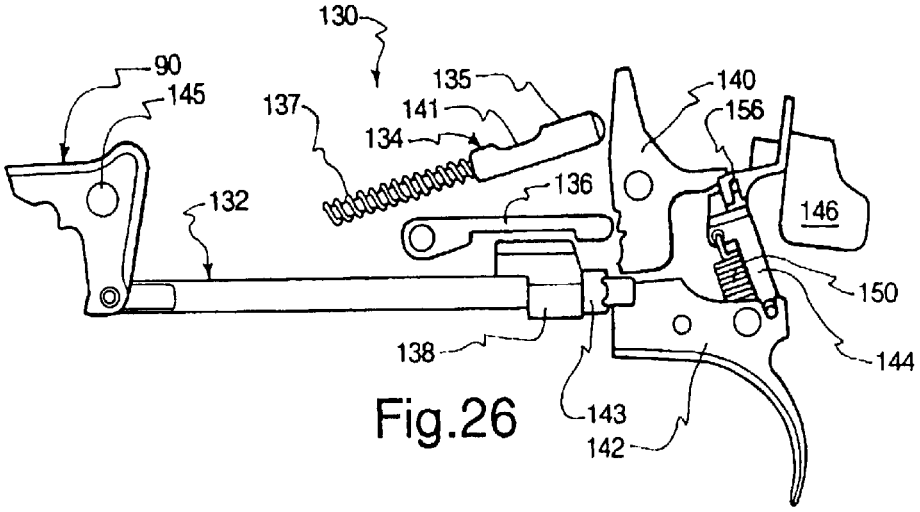
FIG. 26 is a side elevation view of a trigger assembly of the over-and-under shotgun of FIG. 1, showing the trigger having been pulled, but before the striker unit begins to move.
Figure 27:
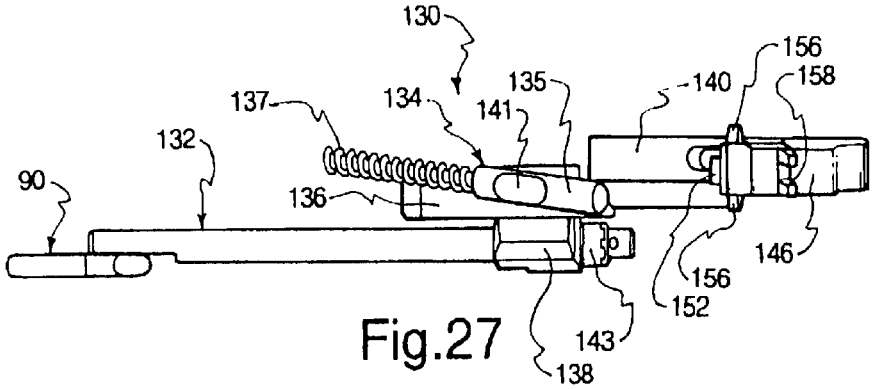
FIG. 27 is a top view of the trigger assembly of FIG. 26.
Figure 28:
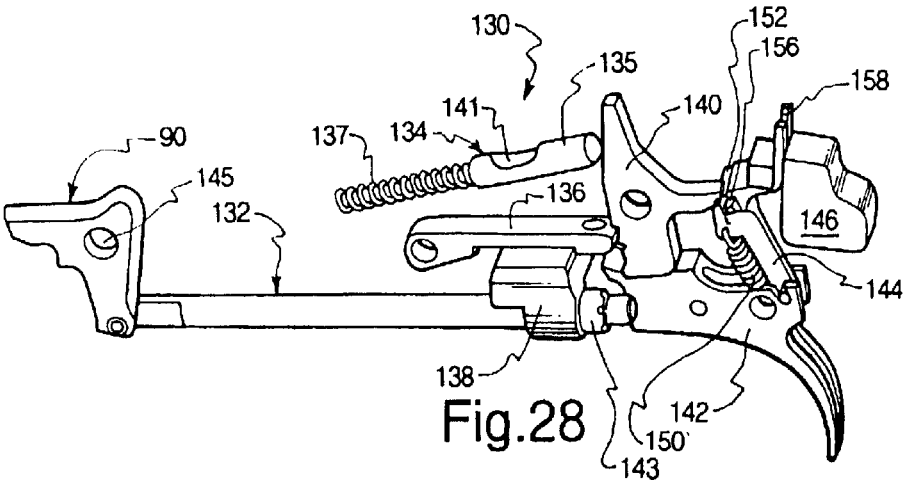
FIG. 28 is a perspective view of the trigger assembly of FIG. 26.
Figure 29:
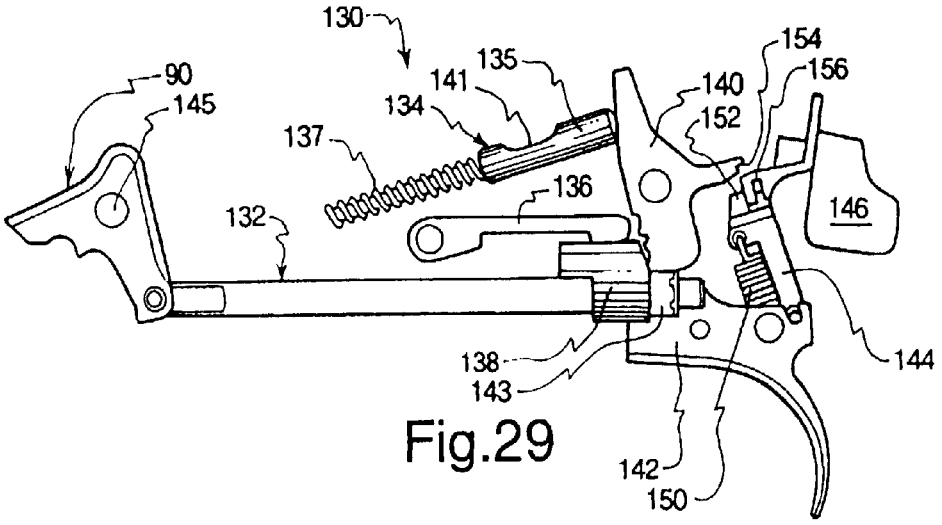
FIG. 29 is a side elevation view of a trigger assembly of the over-and-under shotgun of FIG. 1, showing the trigger assembly having been pulled.
Figure 30:
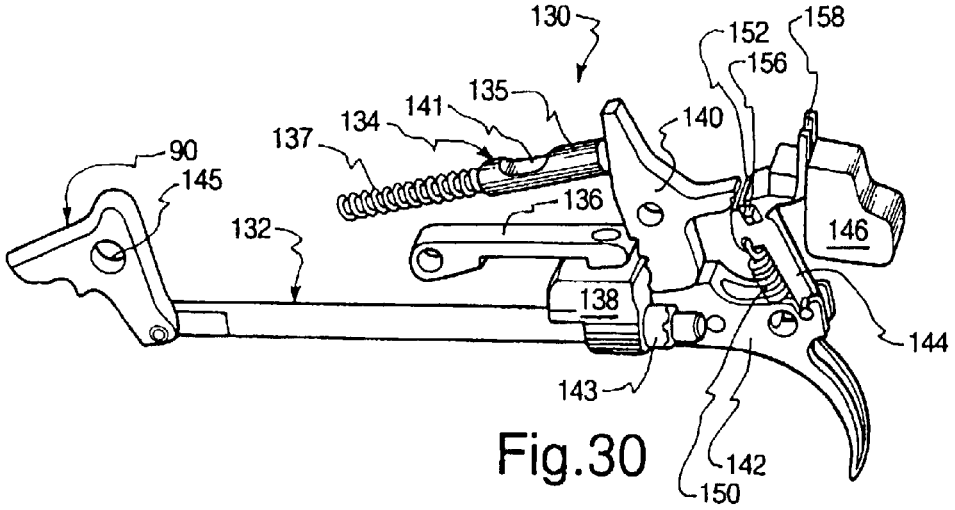
FIG. 30 is a perspective view of the trigger assembly of FIG. 29.
Figure 31:
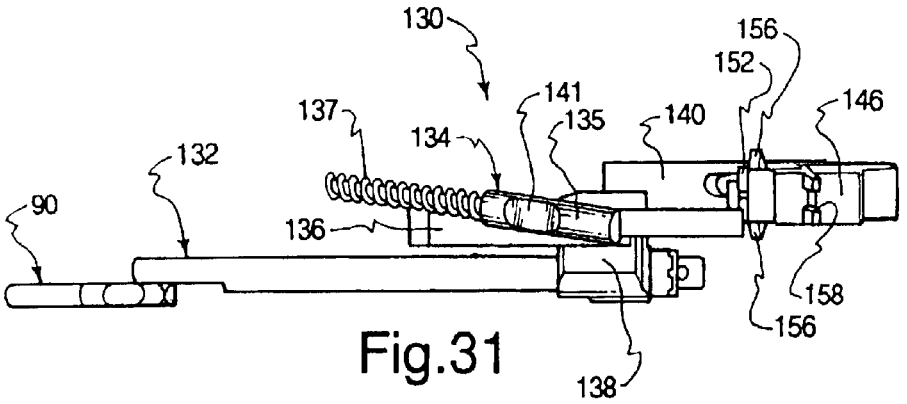
FIG. 31 is a top view of the trigger assembly of FIG. 29.

FIGS. 23–31 show the firing system 130. FIGS. 23–25 show the firing system 130 before the trigger is pulled. FIGS. 26–28 show the firing system 130 after the trigger has been pulled, but just before the striker starts to move. FIGS. 29–31 show the firing system 130 after the trigger has been pulled.

The firing system 130 comprises generally a cocking lever 90, a connecting link 132, a firing pin assembly 134, a sear link 136, a striker 138, a rocker 140, a trigger 142, a trigger link 144, and an inertia mass 146. The assembly, function, and construction of these subparts to the firing system 130 are discussed below.

The cocking lever 90 is used to cock the firearm once it has been fired. A pocket is cut into the frame to house the cocking lever 90. When the firearm is discharged, the cocking lever rotates about pivot point 145, dropping the front portion of cocking lever 90 (which results from the rearward movement of striker 138). As the firearm is opened, the front of the cocking lever 90 is pushed upward by the forearm causing it to rotate about the radius portion. As it rotates, cocking lever 90 pulls the striker 138 toward the front of the firearm. When the firearm is close to a fully opened position, the sear link 136 falls down into a triggering position over the striker 138.

Firing pins 135, biased by springs 137, urge the end of firing pin 135 to engage the upper portion of rocker 140 into a position which catches the sear link and holds it in place until the next shot.

The connecting link 132 couples the cocking lever 90 to the striker 138. Link 132 attaches to cocking lever at pivot point 147. A spring 139 (not shown in FIGS. 23–31) urges the striker 138 toward the rear of the gun. After the bias is overcome when cocking the gun, the sear link 36 hooks over the striker 138 and retains it in position until the trigger 140 is pulled. The connecting link 132 moves in approximately a straight line (although the connection of the connecting link 132 to the cocking lever 90 results in some slight vertical movement of the cocking lever, such movement is not sufficient to cause any type of problem).

The firing pin assembly 134 comprises the firing pin 135 and the firing pin spring 137. The firing pin spring biases the rocker 140 into firing position. This movement allows the gun to be cocked. Each firing pin 135 limits the movement of all parts associated with that pin, including rocker 140 and striker 138. Movement of the firing pin 135 is limited by a pin (not shown) which engages notch 141. The extreme end of firing in 135 (not shown) is narrowed and engages the primer of the cartridge being fired, as understood by those skilled in the art.

The sear link 136 is used to reduce the load transfer on sear surfaces. The striker 138, when in the fully cocked position, produces a substantial horizontal load. The surface between the sear link 136 and the striker 138 is angled so that the large horizontal force from the striker produces a small vertical load, which applies an upward rotational force on the sear link to release the striker 138. The rocker 140 limits the upward rotation of the sear link 136. The striker 138 is held to the connecting link 132 by striker nut 143. When the gun is fired, the trigger rotates the rocker 140, which releases, in turn, sear link 136. The reduction of force caused by the sear link 136 allows for a smoother, lighter trigger movement.

After the striker 138 is released, a spring-bias force, imparted by coil spring 139 (striker spring 139 is shown in FIGS. 2–6, but not in FIGS. 23–31) causes striker 138 to hit the rocker 140 which, in turn, transfers the energy to the rocker 140. The rocker 140 after the energy or momentum has been reversed, strikes the firing pin 135 and moves the pin 135 toward the particular primer (not shown). The rocker 140 has, therefore, two primary functions. First, it transfers the rearward energy of the striker 138 to the forward energy of the firing pin 135. Second, it acts as a sear, which allows the trigger to release the system.

The trigger link 144 allows rotation of the trigger 142 and transfers rotation of the trigger to the rocker 140. A front portion of trigger 142 is used to catch the striker 138 if the sear fails without the trigger being pulled. There are two different engagement surfaces on the trigger link 144. With both barrels unfired, a first front engagement surface 152 (FIGS. 24, 25) contacts one of the rockers at a trigger engagement surface 154 (FIG. 29), depending on which rocker 140 has been biased toward the safety (described below). After firing the first shot, the unseared rocker is pushed out of the way by its associated striker 138. This allows the trigger link to move forward and engage the second rocker with one of the second side engagement surfaces 156.

The inertia mass 146 is used as a weight. During recoil of the gun, the inertia mass pulls the trigger link to the rear of the gun (overcoming bias from spring 150) disconnecting it from the rocker. The inertia mass 146 is free to move in a vertical direction because of its placement within U-shaped saddle 158. The inertia mass 146 prevents rotation of the trigger about its pivot point when the gun is, for example, dropped.

A trigger link spring 150 biases the trigger link 144 toward a forward position. The spring also returns the trigger 142 to the unfired position.

Figure 32:
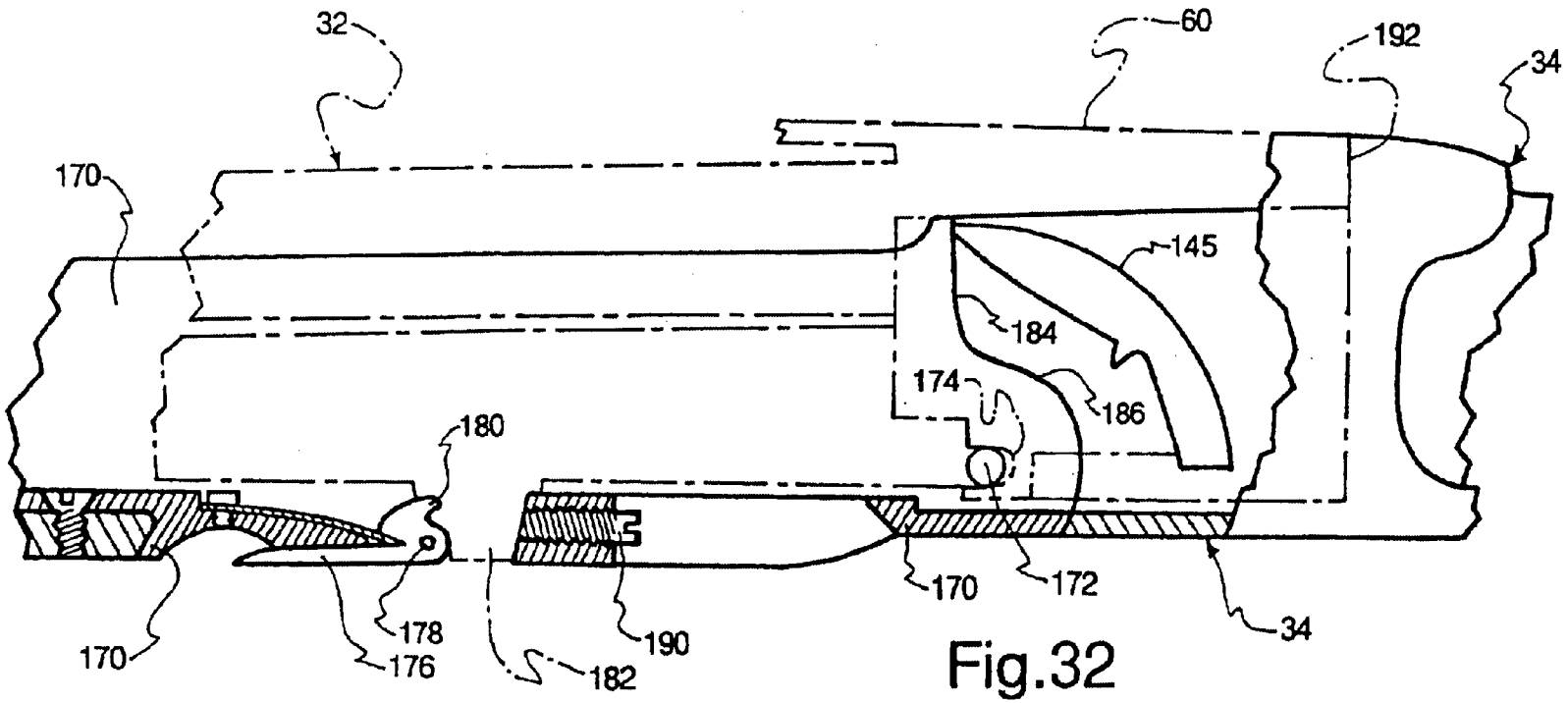
FIG. 32 is a partial, sectional side elevation view of the forearm as the forearm interfacing with the barrel section and the receiver section.
Figure 33:
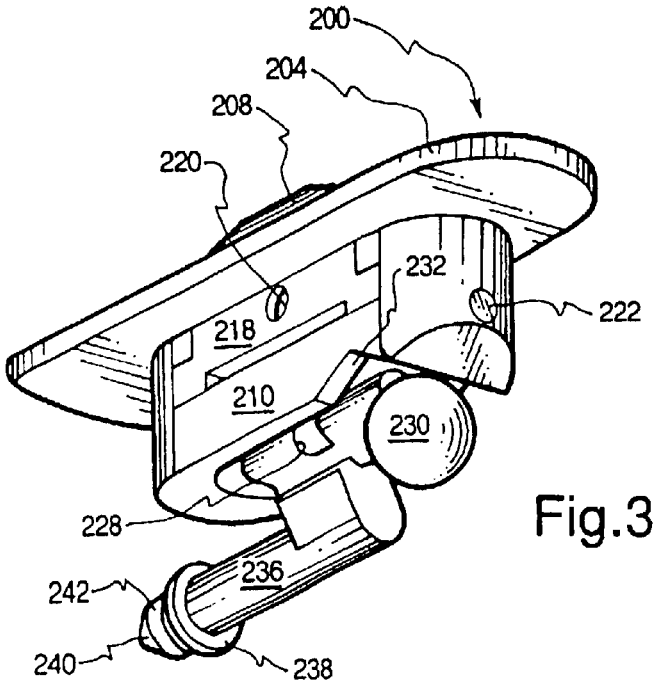
FIG. 33 is a perspective view of a safety switch assembly according to the present invention.

FIG. 32 shows another inventive aspect of the present invention. A forearm 170 (shown partly in section) attaches to the barrel section 32 and interfaces with the receiver section 34 (also shown partly in section). The forearm 170 includes a pair of opposed posts 172 which are inserted into corresponding slots 174 (shown in phantom in FIG. 32) such that opposed posts 172 (only one shown in FIG. 32) have locations in which to ride to place the forearm 170 in a proper position. To secure the forearm 170 in place about the barrel section 32 and in the proper abutment arrangement with respect to receiver section 34, a spring-biased latch 176 pivots about pivot point 178 to release and engage a hook 180 from engagement with a corresponding female area formed on a downwardly extending attachment block 182 (shown in phantom in FIG. 32). The forearm 170 and the receiver 34 engage each other along a first vertical surface 184 and a lower curved abutment or guide surface 186. It should be noted that these surfaces, in combination with bearing surface 145 (which engages a corresponding arcuate-shaped surface formed in the monoblock) are all located on one side of a defined pivot point of the barrel assembly 32 relative to the receiver section 34. It should further be noted that the frame or receiver defines surfaces 145 and the corresponding abutment surface relative to abutment area 186. The surfaces on the forearm which abut against the frame or receiver 34 to provide abutment areas 184, 186 act in combination with bearing surface 47 (FIG. 8) formed in the monoblock to in essence "clamp together" the surfaces on the frame or receiver 34 which form part of abutment areas 184, 186, and bearing surface 145. This provides a tight fit for the hinge created by surfaces 186 (comprising both the appropriate portion of the forearm 170 and the appropriate portion of receiver 34) and radius track 145 formed in the frame or receiver 34.

Figure 4:
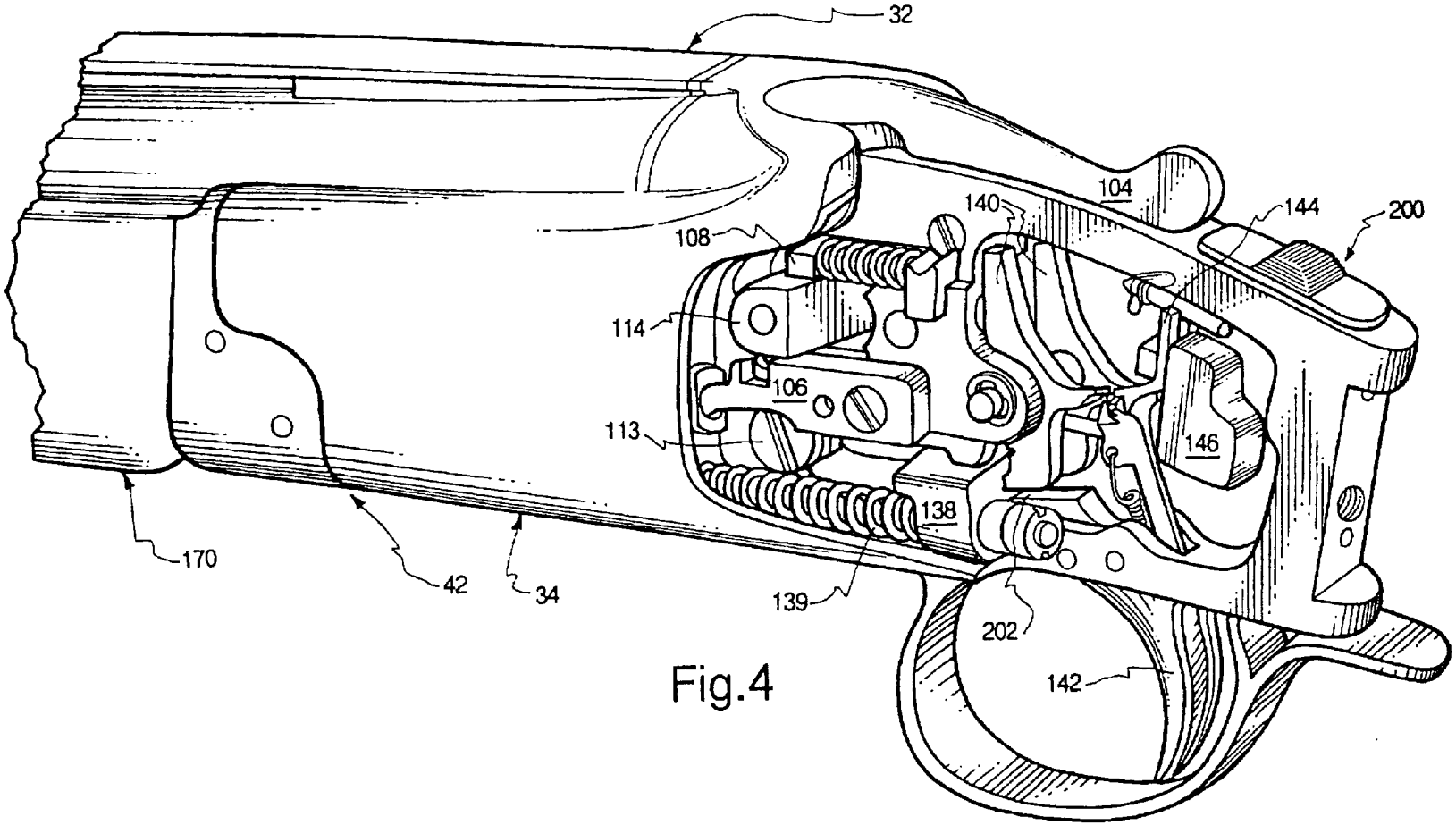
FIG. 4 is a partial perspective view of a portion of the over-and-under shotgun of FIG. 1, with the breech in a closed position.
Figure 5:
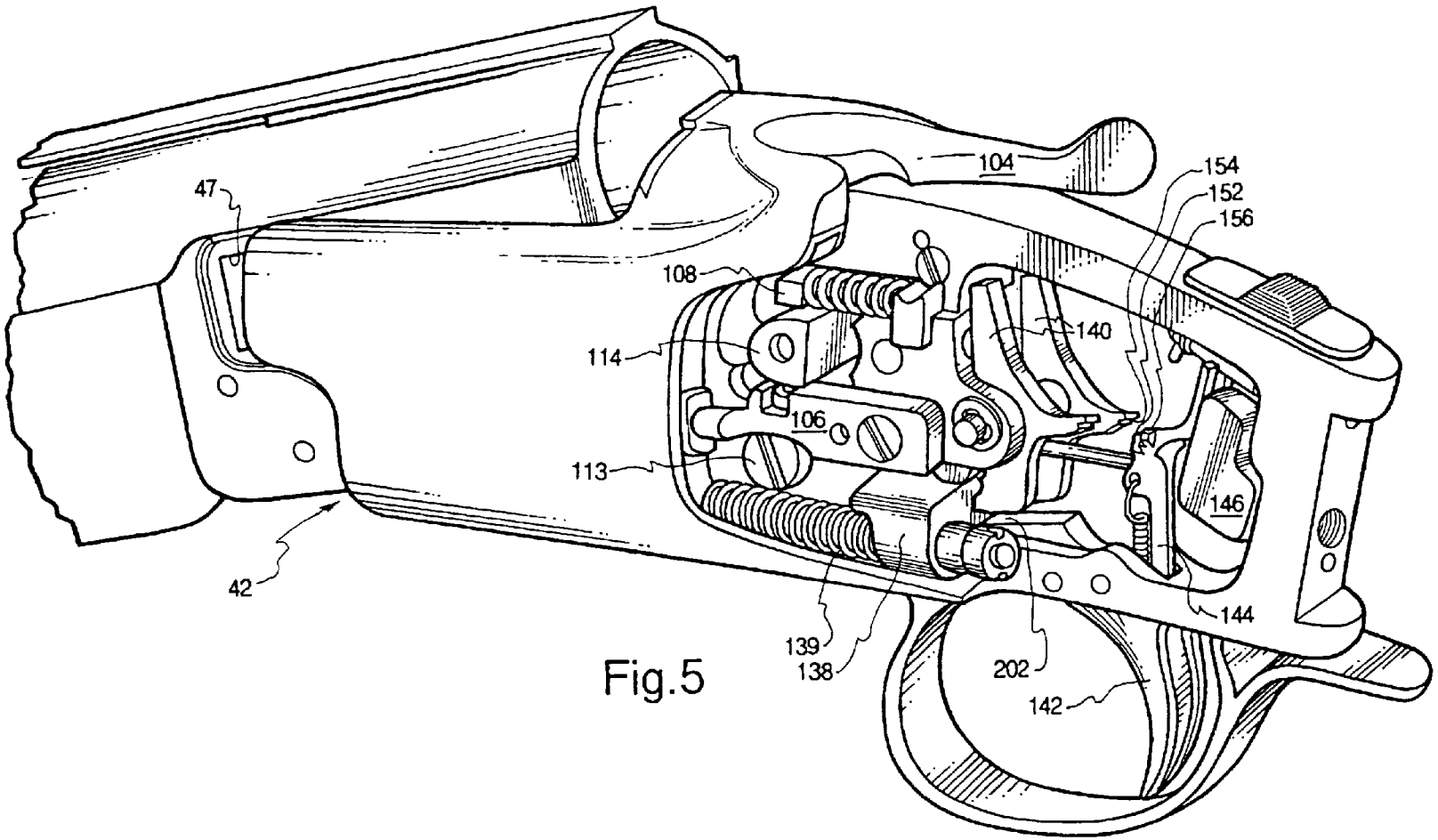
FIG. 5 is a partial perspective view of a portion of the over-and-under shotgun of FIG. 1, with the breech of the shotgun in a partially opened position.

The tightness of the hinge created by the above-referenced surfaces may be adjusted. A pressure adjuster in the form of an adjustment screw 190 is provided in the forearm 170 (FIGS. 1, 4, 32). The adjustment screw 190 may be utilized to vary the pressure placed by the forearm 170 against the receiver 34 at abutment areas 184, 186. By rotating adjustment screw 190, the surface of the forearm bearing against attachment block 182 will change, which will vary, in turn, the pressure placed on abutment areas 184, 186. It should be noted that slot 174 is elongated so as to allow some adjustability in relation to abutment surfaces 184, 186. Thus the forearm 170 is moveable longitudinally by the rotating of the adjustment screw 190, which also varies bearing force between the forearm 170 and the attachment block 182.

Still another aspect of the hinge or action relates to the surfaces which bear against each other at abutment area 192 (shown in phantom in FIG. 32) when the action closes. In closing the action of firearm, a surface of the monoblock 60 bears against a surface on the frame or receiver 34 at abutment area 192. To adjust the stopping point of the action, a steel insert may be included on one side of abutment area 192 to adjust the location where the abutment surfaces meet.

Figure 2:
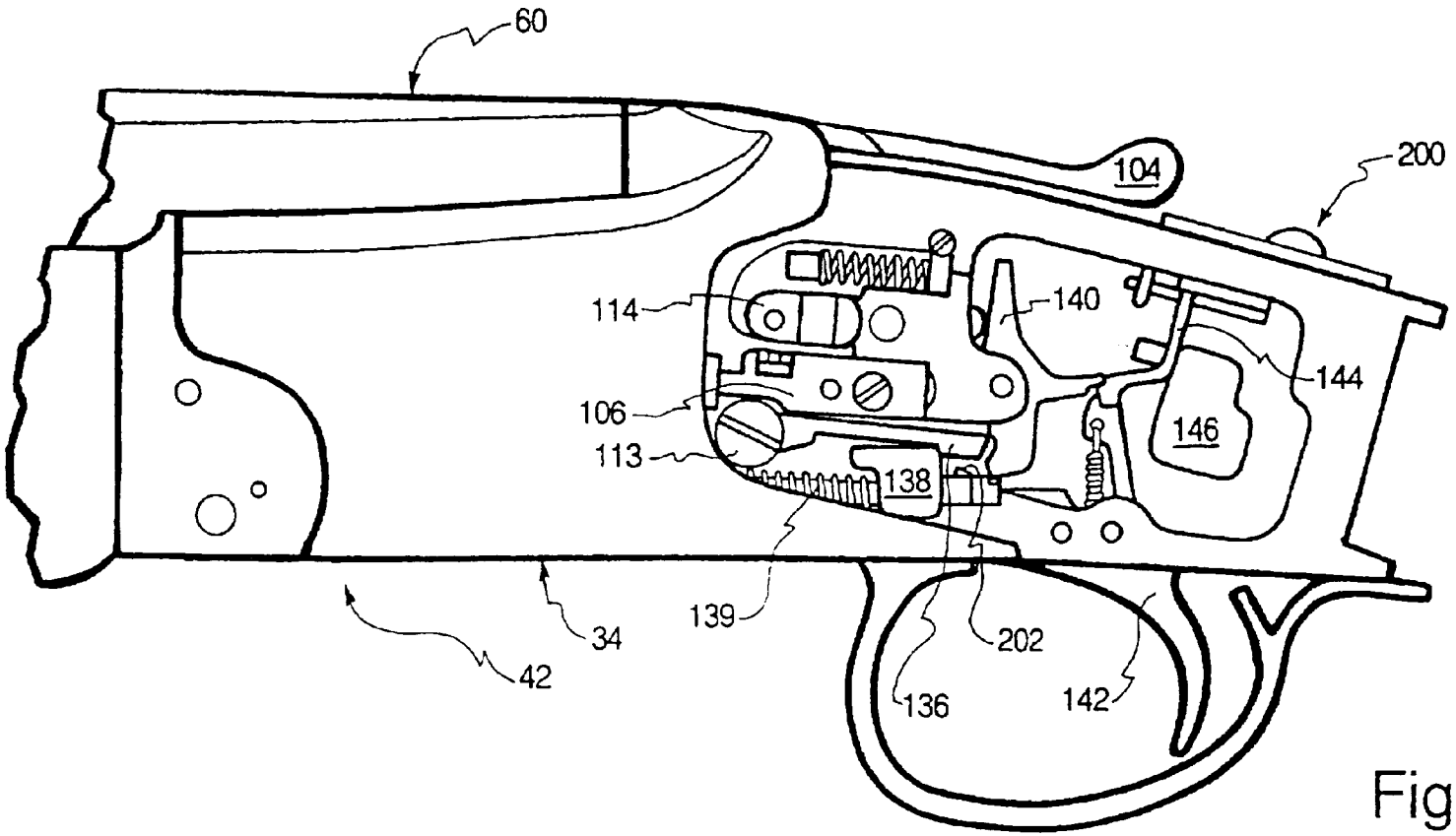
FIG. 2 is a partial side elevation view showing a portion of an over-and-under shotgun of FIG. 1 with the breech in a closed position.

Another inventive aspect of the present invention relates to the various safety systems. A first system is a safety system 200 incorporated into the trigger link 144. An extended flange 202, as shown in FIGS. 2 and 28, blocks the path of the striker 138 when the trigger 142 is not pulled. Thus, in the unlikely event that the firearm experiences an impact from an external force, which might happen if the firearm is dropped, and in the event that the striker 138 is unintentionally released from the sear arm 136, the extended flange 202 will block the striker 138 (either or both) and prevent it from engaging the rocker 140.

Figure 34:
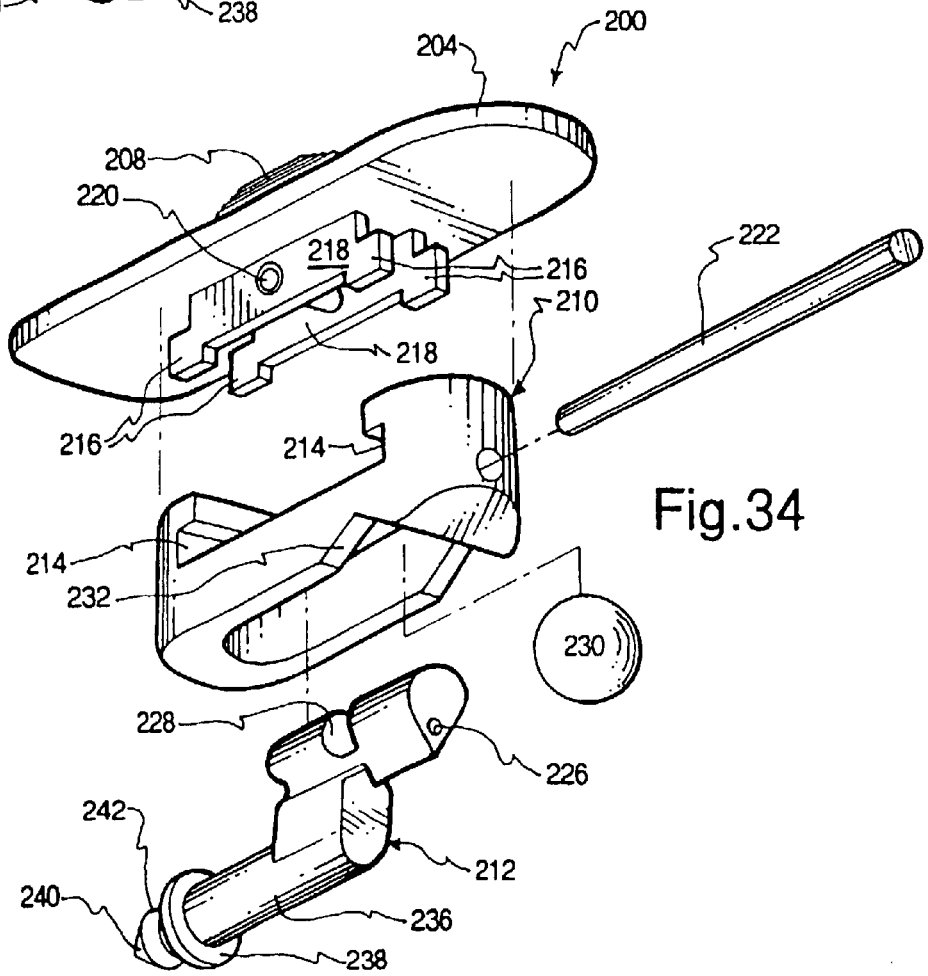
FIG. 34 is an exploded perspective view of the safety switch assembly of FIG. 33.
Figure 35:
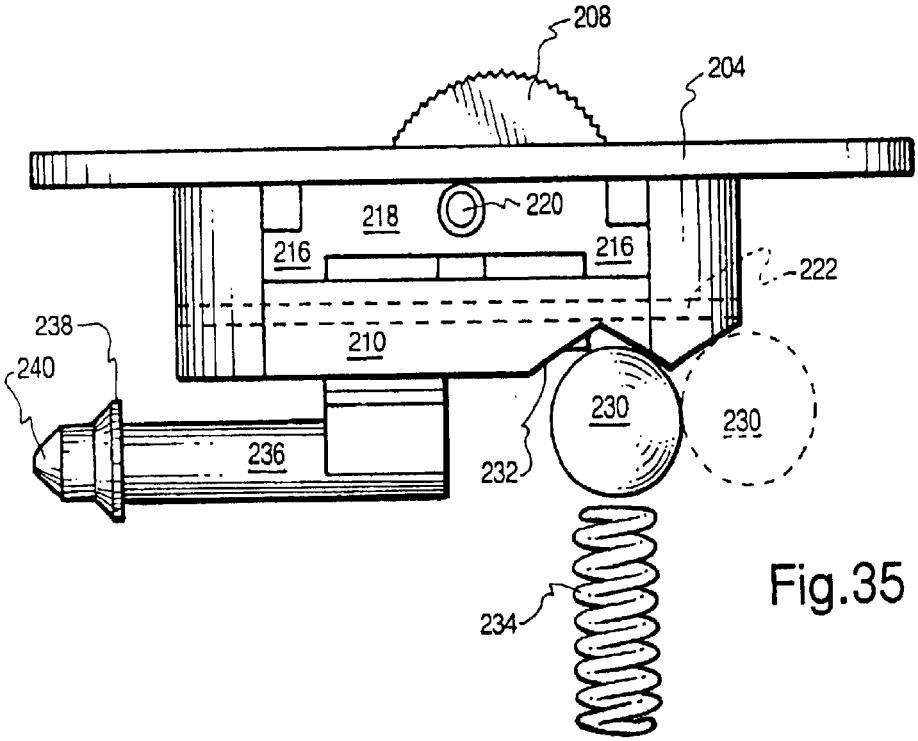
FIG. 35 is a side elevation view of the safety switch assembly of FIG. 33.
Figure 36:
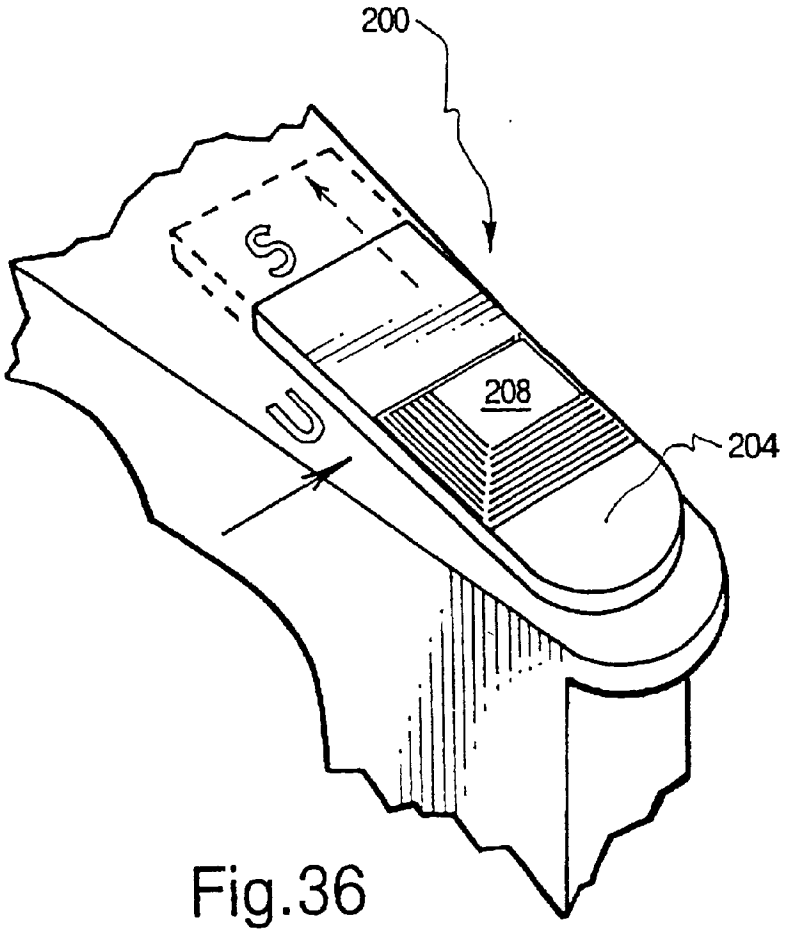

A second safety system is shown in FIGS. 33–38. This system utilizes a safety switch 204. The safety switch 204 allows the firing sequence of the barrels to be adjusted. Safety switch 204 can be positioned so that either barrel fires first followed by the other. As shown in FIGS. 35–36, the safety switch 204 can be moved either to the left or the right, and can be moved forward or backward. The left-to-right movement will determine which of the two firearm barrels (the upper or the lower barrel) the trigger will discharge. Moving the switch to expose the "O" will cause the top (or "over") barrel to discharge first. Moving the switch 204 to expose the "U" will cause the bottom (or "under") barrel to discharge first. Moving the switch 204 forward will render the trigger operable in the firing sequence designated by the left/right movement of the safety switch 204.

As shown in detail in FIGS. 33–39, the safety system 200 more particularly comprises a safety switch 204 having a raised, ridged area 208, a suspended middle safety slide 210, and a pivoting selector arm 212. The intermediate safety slide 210, as shown in FIG. 34, includes opposed notched areas 214 which are sized to receive similarly configured extension sections of flanges 218 extending downwardly from the top switch plate 204. A pin 220 interconnects the flanges 218 to one another. In assembly, the top switch plate 204 is mounted to the outside of the receiver of the firearm by inserting the flanges 218 through apertures (not shown) formed in the top of the frame or receiver section 34. The intermediate safety slide 210 is then slidably secured over extension sections 216 so that the intermediate safety slide 210 is suspended by extension areas 216. A second pin 222 is inserted through the receiver and a corresponding aperture 224 in the safety slide 210 and aperture 226 selector arm 212, respectively, to secure the assembly in place. Slot 228 formed in selector arm 212 rides over roll pin 220. This maintains the selector 212 in the same front-to-rear orientation as the safety top plate 204. An index ball 230 seats inside a notched portion 232 in the bottom side of the intermediate support structure 210. The ball 230 is supported by a coil spring 234 (FIG. 35) which biases the ball into engagement with notched area 232. The ball 230 indexes the pivoting selector arm 212 with respect to one of the two positions: a safety "on" position corresponding to rearward movement of switch 204, and safety "off" position corresponding to forward movement of switch 204.

Figure 37:
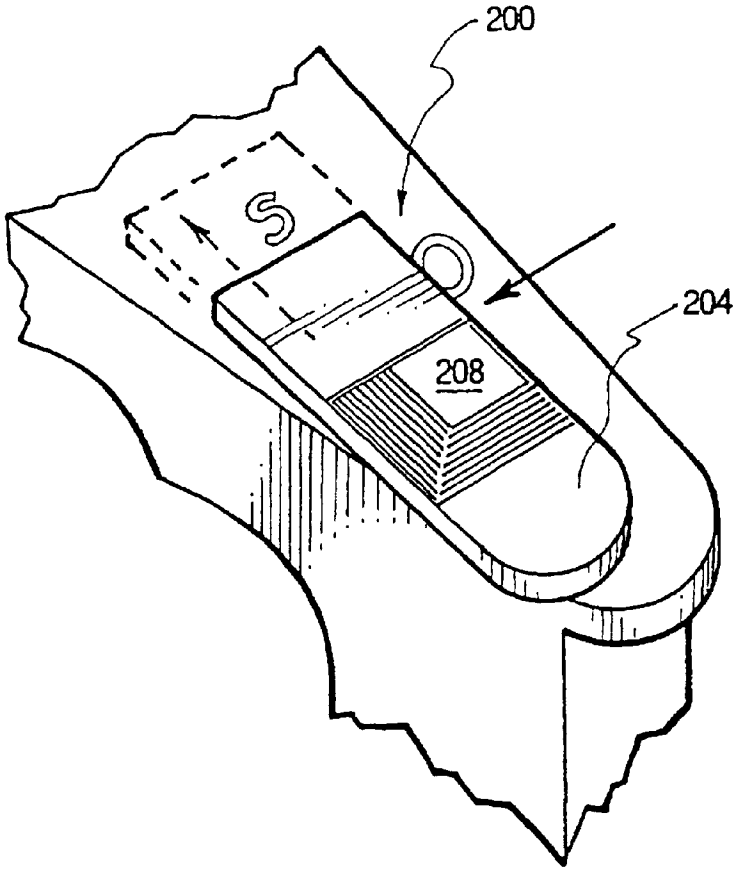
FIGS. 36–39 are perspective views showing the operation of the safety switch assembly of FIG. 33.

The selector 212 also comprises a selector shaft 236, a bushing 238, and a conically-shaped head 240. A circularly annularly shaped recess 240 is defined by the conically-shaped end 240 and the bushing 238. When the safety switch 204 is placed in the safety "on" position (which will correspond to safety switch 204 being in a rearward position as shown in FIGS. 36 and 37), bushing 238 pulls the trigger link 144 back out of the way so that surfaces 152, 156 (FIGS. 23–31) cannot engage the rocker 140 and discharge the firearm. When the safety is moved forward to the safety "off" position (opposite of what is shown in FIGS. 36 and 37), the bushing 238 moves forward and trigger spring 150 (FIGS. 23–31) pulls the trigger link 144 forward so that surfaces 152, 156 can engage the rocker arms 140 and discharge the firearm.

Figure 39:
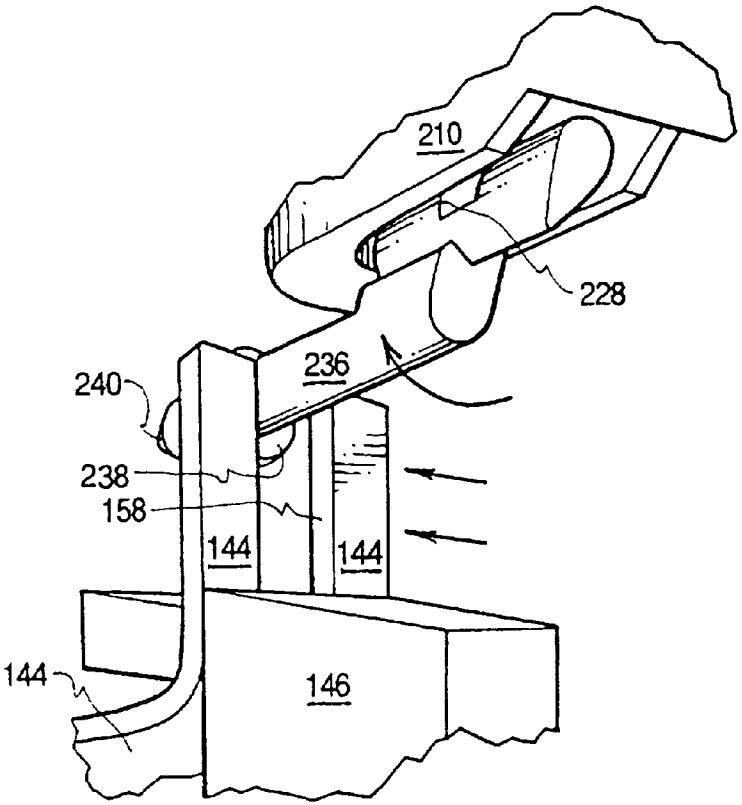
Figure 38:
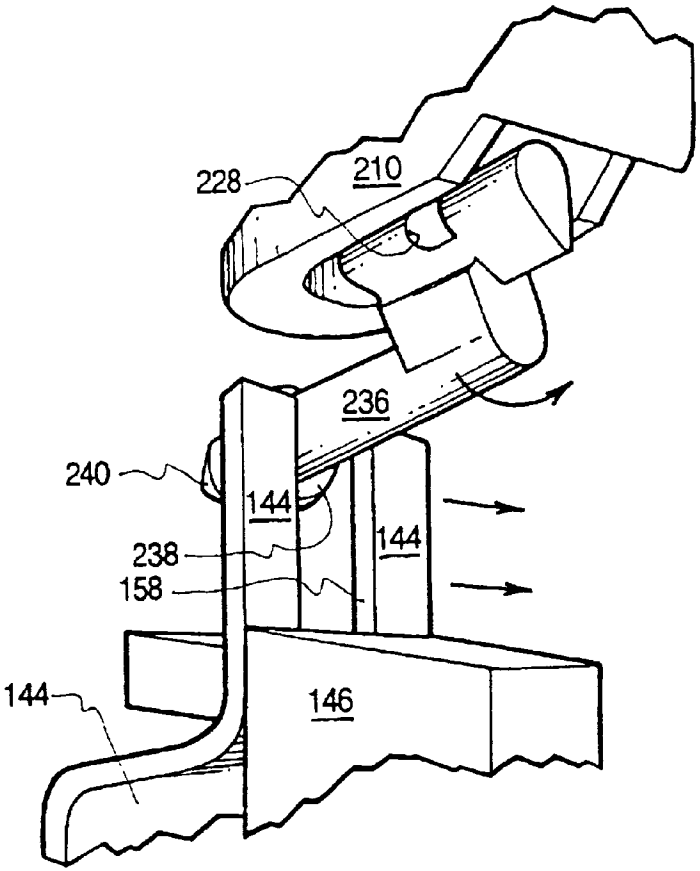

As shown in FIGS. 38 and 39, when selector arm 236 is moved to the right, surface 152 (FIG. 27) will engage the sear arm 136 on the left hand side of the gun and surface 156 will engage the sear arm 136 located on the right hand side of the firearm. When, on the other hand, the selector arm 236 is moved toward the left side (FIG. 39), surface 152 will engage the rocker 140 on the left hand side of the firearm and surface 156 will engage the rocker on the right hand side of the firearm. By this left or right movement of safety switch 204, the firing sequence of the over-and-under shotgun can be varied.

Figure 40:
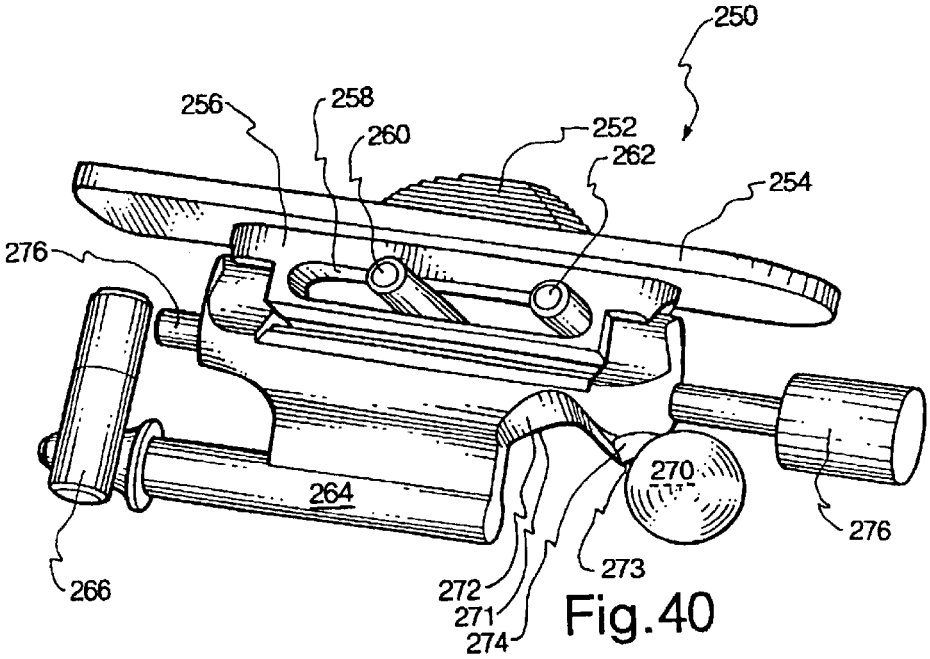
FIG. 40 is a perspective view of an alternative embodiment of a safety switch assembly according to the present invention.
Figure 41:
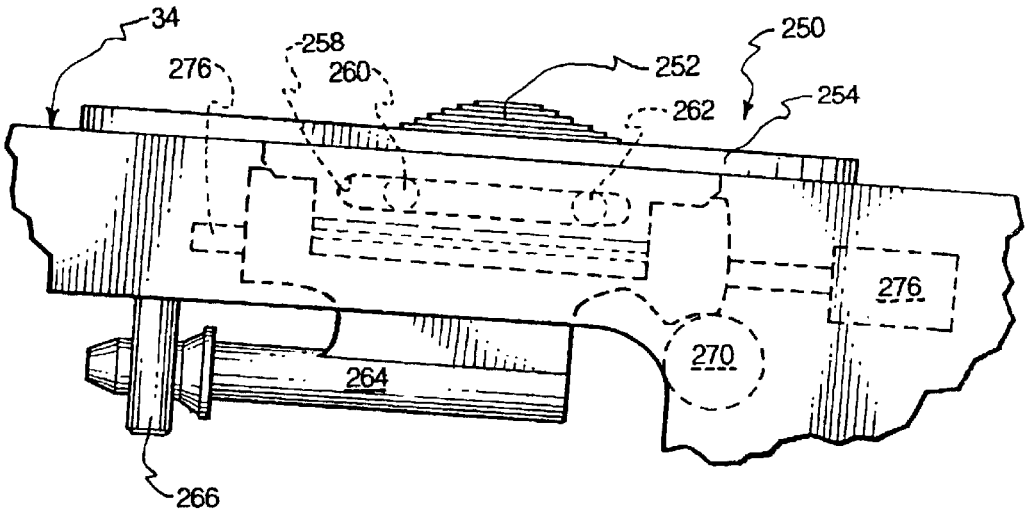
FIG. 41 is a side elevation view of the safety switch assembly, shown partially by hidden lines, incorporated into the firearm according to the present invention.

An alternative embodiment of a safety switch 250 is shown in FIGS. 40 and 41. The safety 250 includes a safety button 252 which, similar to the previous embodiment, comprises a raised area having ridges. A safety plate 254 (from which the button 252 extends) integrally incorporates a lower extension portion 256 which forms a longitudinal slot 258 in which stationary posts 260, 262 coupled to the frame or receiver 34 ride. Further coupled to the lower extension portion 256 is a selector shaft 264 which determines which of the barrels (the upper barrel or lower barrel) is fired first, similar to the previous embodiment. If the button 252 is moved to the extreme left-hand side of the firearm, the shaft 246 will be on the right-hand side of vertical post 266 for firing the upper barrel first. Moving the switch to the opposite side (which will cause the selector shaft 264 to move to the left-hand side) will cause the lower barrel to fire first.

A novel four-face surface extends integrally from selector shaft 264. The ball 270 is indexed upwardly into engagement with one of the four faces (the faces are angled and converge at bottom edges 271, 273 as shown in FIG. 40). The ball may engage a pair of first, deep slots or grooves 272 (only one shown in FIG. 40) or, alternatively, into engagement with one of a pair of second, shallow slots or grooves 274 (only one shown in FIG. 40). With the ball 270 riding in one of the grooves 272, the button 252 can be moved to either a left-side position or a right-side position, and the ball will switch between engagement with one of the sloped surfaces which define grooves 272. Additionally, when the ball 270 rides in one of slots 272 (by backward movement of switch 252 such that shafts 260, 262 ride toward the front of slot 258), the gun is in a "safe" or non-firing position. When the button 252 is moved in a forward position, or the "firing" position, the vertical post 266 will maintain the selector 264 on side of post 266 and will prevent the button 252 from moving side-to-side. The firing sequence of the barrels is the same as with the previously described with respect to the safety switch embodiment of FIGS. 33–39. A fastener 276 is inserted through the frame or receiver portion of the firearm to hold the safety assembly 250 in place. Fastener 276 may be threadedly received by the frame.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications with the proper scope of the appended claims appropriately interpreted in accordance with the doctrine of equivalents.

What is claimed is:

1. An over-and-under shotgun apparatus, comprising:

a firearm comprising a barrel, a forearm, and a receiver;

a curved abutment interface formed between the barrel and the receiver, the curved abutment interface comprising a convex portion and a concave portion, the convex portion exerting a bearing force against the concave portion;

an externally adjustable pressure adjuster coupled to the forearm to manually adjust the bearing force.

2. An over-and-under shotgun apparatus according to claim 1 wherein the adjuster comprises a screw that moves the forearm toward and away from the receiver.

3. An over-and-under shotgun apparatus according to claim 1 wherein the forearm interconnects the shotgun barrel and the receiver.

4. An over-and-under shotgun apparatus according to claim 1, wherein the forearm is longitudinally movable by the adjuster vary the bearing force.

5. An over-and-under shotgun apparatus according to claim 1 further comprising a pivot axis around which the barrel and receiver rotate, wherein the pivot axis does not include a bushing, trunnion, or pivot pin.

6. An over-and-under shotgun apparatus according to claim 1 wherein the curved abutment interface comprises a convex portion formed on the receiver and a concave portion formed on the barrel.

7. An over-and-under shotgun apparatus according to claim 1 wherein the convex portion and the concave portion define a pivot axis about which a fore end of the shotgun pivots relative to an aft end of the firearm, and wherein the convex portion and the concave portion meet at the curved abutment interface, the pivot axis being spaced from the curved abutment interface.

8. An over-and-under shotgun apparatus according to claim 1 wherein the concave portion and the convex portion meet at and engage each other along the curved abutment interface, the convex portion and the concave portion defining a pivot axis remote from the abutment interface, a portion of the curved abutment interface being concentric with respect to the pivot axis.

9. An over-and-under shotgun apparatus according to claim 1 wherein the concave portion and the convex portion meet at and engage each other along a curved abutment interface, the convex portion and the concave portion defining a pivot axis remote from the abutment interface, the curved abutment interface comprising less than a semicircle.

10. An over-and-under shotgun apparatus according to claim 1 wherein the concave portion and the convex portion meet at and engage each other along the curved abutment interface, the curved interface allowing the fore end to pivot relative to the aft end such that the concave portion and the convex portion slidingly engage each other as the fore end pivots relative to the aft end.

11. An over-and-under shotgun apparatus according to claim 1 wherein the convex portion and the concave portion define a pivot axis about which the fore end pivots relative to the aft end, the pivot axis being located on the lower half of the shotgun apparatus.

12. An over-and-under shotgun apparatus; comprising:

a firearm comprising a barrel and a receiver;

a curved abutment interface formed between the barrel and the receiver, the curved abutment interface comprising a convex portion and a concave portion, the convex portion exerting a bearing force against the concave portion;

a pressure adjuster coupled to one of the shotgun barrel or the receiver to adjust the bearing force;

wherein the shotgun apparatus comprises a vertical top-to-bottom dimension of less than 2½ inches.

13. An over-and-under shotgun apparatus; comprising:

a firearm comprising a barrel and a receiver;

a curved abutment interface formed between the barrel and the receiver, the curved abutment interface comprising a convex portion and a concave portion, the convex portion exerting a bearing force against the concave portion;

a pressure adjuster coupled to the one of the shotgun barrel or the receiver to adjust the bearing force;

wherein the shotgun apparatus comprises a vertical top-to-bottom dimension comprises approximately 2⅜ inches.

* * * * *